US012690683B2

(12) United States Patent
Tramutola

(10) Patent No.: US 12,690,683 B2
(45) Date of Patent: Jul. 28, 2026

(54) OUTDOOR SEATING TECHNIQUES

(71) Applicant: Christopher A. Tramutola, Greenwich, CT (US)

(72) Inventor: Christopher A. Tramutola, Greenwich, CT (US)

( * ) Notice: Subject to any disclaimer, the term of this patent is extended or adjusted under 35 U.S.C. 154(b) by 37 days.

(21) Appl. No.: 18/658,843

(22) Filed: May 8, 2024

(65) Prior Publication Data

US 2025/0344860 A1 Nov. 13, 2025

(51) Int. Cl.
*A47C 1/032* (2006.01)

(52) U.S. Cl.
CPC ..... *A47C 1/03294* (2013.01)

(58) Field of Classification Search
CPC ..... A47C 1/03294
USPC ..... 297/300.7; D6/334
See application file for complete search history.

(56) References Cited

U.S. PATENT DOCUMENTS 2,385,072 A * 9/1945 Gray ..... A47C 4/14 297/31
4,359,244 A * 11/1982 Koehm ..... A47C 5/10 297/16.2
4,707,023 A * 11/1987 Hickey ..... A47C 4/08 297/39
4,712,837 A * 12/1987 Swilley ..... A47C 4/021 297/440.13
4,976,492 A * 12/1990 Ziegler ..... A47C 4/14 297/39
5,009,466 A * 4/1991 Perry ..... A47C 1/03294 297/300.1
5,131,717 A * 7/1992 Kaminiski ..... A47C 1/0352 297/316
5,911,469 A * 6/1999 Young ..... A47C 7/54 297/39
6,000,755 A * 12/1999 Uhlenbrock ..... A47C 1/03205 297/316

(Continued)

FOREIGN PATENT DOCUMENTS

CN 111317289 6/2020
DE 202008005590 8/2008

OTHER PUBLICATIONS

Canadian Home Leisure, "The Muskoka Chair vs. Adirondack Chair," available at https://canadianhomeleisure.ca/muskoka-chair-vs-adirondack-chair/, accessed on Jun. 13, 2024, 11 pages.

(Continued)

*Primary Examiner* — Jose V Chen
(74) *Attorney, Agent, or Firm* — BECKMAN LAW P.C.; Christopher Beckman

(57) ABSTRACT

New forms of wide-bodied, slat-constructed chairs, and methods for their use, are provided. In some embodiments, a wide-bodied, slat-constructed chair is provided which includes a reclined seatback, a sloped seat, wide-set yet thinner-than-traditional armrests, and a non-quadrilateral base. The non-quadrilateral base includes a specialized support structure with a specialized footprint, having, among other features, a generally triangular, three-legged base, having a limited footprint. In some embodiments, such a specialized support structure includes a single rear leg. In some embodiments, such a single rear leg is provided which does not extend rearward past or, in some embodiments, substantially past, the seatback of the chair.

16 Claims, 32 Drawing Sheets

(56) References Cited

U.S. PATENT DOCUMENTS

| | | | | |
|---|---|---|---|---|
| 6,935,689 | B2 * | 8/2005 | Horiki | A47C 1/03266 297/302.6 |
| 8,814,261 | B2 * | 8/2014 | Chamberlain | A47C 4/52 297/39 |
| D752,354 | S | 3/2016 | Fairbanks | |
| D779,849 | S | 2/2017 | White, III et al. | |
| 9,717,341 | B1 * | 8/2017 | Gibson | A47C 4/03 |
| D995,135 | S * | 8/2023 | Zhaowen | D6/370 |
| 12,011,100 | B1 * | 6/2024 | Zhou | A47C 1/14 |
| 12,082,710 | B2 * | 9/2024 | Reinhart | A47C 3/04 |
| D1,073,349 | S * | 5/2025 | Shi | D6/370 |
| 12,383,063 | B2 * | 8/2025 | Cui | A47C 1/02 |
| 2007/0273190 | A1 * | 11/2007 | Gehner | A47C 31/126 297/300.2 |
| 2015/0327675 | A1 * | 11/2015 | Fenner | A47B 83/02 297/148 |
| 2016/0007755 | A1 * | 1/2016 | Adams, IV | A47C 5/12 297/411.43 |
| 2016/0220027 | A1 | 8/2016 | Milde | |

OTHER PUBLICATIONS

Carl Hansen & Son, "CH07 | Shell Chair," available at https://www.carlhansen.com/en/en/collection/chairs/lounge-chairs/ch07/ch07-oak-white-oil-hr-fsc70-thor-301/variant/10660#aw_source=pa-65d6fe707fe22500ef41dd25%7C6666be66c531006b71b72415%7C/en/en/collection/chairs/lounge-chairs%7C, accessed on Jun. 13, 2024, 7 pages.

Design Within Reach, "Crate Lounge Chair," available at https://www.dwr.com/outdoor-lounge-chairs-ottomans/crate-lounge-chair/100377501.html?lang=en_US, accessed on Jun. 13, 2024, 2 pages.

The Best Adirondack Chair Company, "Muskoka Chairs Vs Adirondack Chairs: What's the Difference?," available at https://thebestadirondackchair.ca/blogs/journal/muskoka-chairs-vs-adirondack-chairs-the-best-adirondack-chair-company, accessed on Jun. 13, 2024, 7 pages.

Wikipedia.org, "Adirondack Chair," available at https://en.wikipedia.org/w/index.php?title=Adirondack_chair&oldid=1174065993, accessed on Dec. 14, 2023, 2 pages.

* cited by examiner

OUTDOOR SEATING TECHNIQUES

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Unless otherwise stated, all trademarks and trade dress disclosed in this patent document and other distinctive names, emblems, and designs associated with product or service descriptions, are subject to trademark rights. The trademark and trade dress owner also reserves all trademark rights whatsoever.

FIELD OF THE INVENTION

The present disclosures relate to new types of chairs, adapted for outdoor use. More specifically, some of the present disclosures relate to new types of wide format chairs built predominantly from slats and used for outdoor rest and relaxation.

BACKGROUND

Wide-bodied, slat-construction chairs, such as the Adirondack Chair and the Muskoka Chair, have been used in outdoor rest and relaxation contexts for at least 120 years. These chairs became popular in the early 20th Century, after the introduction of the Adirondack Chair. At the turn of the century, the Adirondack Chair was invented by Thomas Lee, of Westport, New York, as an outdoor chair having wide, flat armrests, a greatly reclined seatback, and a sloped seat, higher in the front than the back. At around this time, tuberculosis outbreaks had become a serious health concern in the United States, and a number of convalescent retreats were opened in rural settings, such as upstate New York. Relaxation and fresh air in an outdoor setting was thought to be beneficial for tuberculosis patients. Harry C. Bunnell further developed the Adirondack Chair for that purpose in these settings. The wide-frame construction of these chairs served to open patients' chests, and ease breathing.

These benefits proved to be widely-appreciated, well beyond the convalescent context, and people throughout the World began using them for more general outdoor relaxation and recreation. The Adirondack chair remains one of the most popular and successful deck and outdoor chairs, in much the same form.

In about 1938, the design was altered to a multi-slat construction for the chair back, by Irving Wolpin. Thus, in its current popular form, the Adirondack Chair is constructed with a greatly reclined multi-slat chairback and seat, wide, flat armrests, and two widely-spaced chair-legs, which are set substantially behind the back of the seat and prevent tipping due to the substantial reclination of the seatback.

The Adirondack Chair remains in heavy use today, particularly in large, natural, outdoor settings, and in much the same form. Modern variants of the Adirondack Chair and Muskoka Chair may be constructed of different slat materials other than wood, such as plastics and other waterproof materials. But the design of the Adirondack chair has remained essentially unchanged for decades.

There is a long-felt need for better outdoor furniture and improvements to wide-bodied, slat-construction chairs, such as the Adirondack Chair and the Muskoka Chair.

It should be understood that the disclosures in this application related to the background of the invention, in, but not limited to this section titled "Background," do not necessarily set forth prior art or other known aspects exclusively, and may instead include art that was invented concurrently or after the present invention and conception, and details of this application's inventor's own discoveries and work and work results.

SUMMARY OF THE INVENTION

New forms of wide-bodied, slat-constructed chairs, and methods for their use, are provided. In some embodiments, a wide-bodied, at least partially slat-constructed chair in accordance with aspects of the present application includes a reclined seatback, a sloped seat, wide-set yet thinner-than-traditional armrests, and a non-quadrilateral base. In some embodiments, the non-quadrilateral base includes a specialized support structure with a specialized footprint, having, among other features, a generally triangular, three-legged base, occupying a more limited floor area in comparison with a traditional Adirondack Chair. In particular, some embodiments of such a specialized support structure include a more limited than traditional footprint, especially at the rear of the support structure. For example, in some embodiments, such a specialized support structure includes a single rear leg. In some embodiments, such a single rear leg is provided which does not extend rearward past or, in some embodiments, substantially past, the seatback of the chair, or a portion thereof (e.g., a middle, rear area of the seatback).

In some embodiments, such a specialized support structure includes two side legs. In some such embodiments, the two side legs are abbreviated, meaning that they do not extend, or do not substantially extend, into a rear area of the specialized support structure. For example, in some embodiments, the two abbreviated side legs do not extend rearward past the horizontal position of a lower, rearward edge of the seatback. As another example, in some embodiments, the two abbreviated side legs do not extend rearward, or, in some embodiments, they do not extend substantially rearward, past the back of the seat bottom of the chair. As yet another example, in some embodiments, the two abbreviated side legs do not extend rearward, or, in some embodiments, they do not extend substantially rearward, past a lower, rearward corner of a seat of the chair. In some embodiments, the abbreviated side legs are located at or about the middle and/or front of the three-legged base and the chair.

In some embodiments, such abbreviated side legs are be formed from a plurality of component pieces of wood. For example, in some embodiments, also as pictured, the abbreviated side legs may each be formed from at least two, three, four, five, six, seven, eight, nine, ten, eleven, twelve, thirteen, fourteen, fifteen, sixteen, seventeen, eighteen, nineteen, twenty, twenty-one, twenty-two, twenty-three, twenty-four, twenty-five, or more pieces of wood, in various embodiments. In some such embodiments, at least some of the plurality of pieces of wood may be rectilinear dimensional lumber or other wood pieces. In some embodiments, at least some of the plurality of pieces of wood may have a non-square (oblong) profile, even if they are rectilinear (as pictured). In some such embodiments, all or at least some of the plurality of pieces of wood may have a non-square (oblong) profile, and, in some such embodiments, may be joined (e.g., by fasteners or adhesives) in a perpendicular arrangement, with a shorter surface of one piece joined to the longer surface of another piece.

In some embodiments, one or more of the abbreviated side legs are joined to, and/or integral with, a front vertically-oriented frame component which, in turn, is joined to an armrest. In some embodiments, the front vertically-oriented frame component and the armrest component may each be similarly formed from a plurality of pieces of wood, having a rectilinear shape and being joined together in particular orientations, as discussed above with respect to the abbreviated side pieces. In some embodiments, when joined together, the abbreviated side legs, the vertically-oriented frame components thereof, and the armrest component, may form a U-, C- or other arch-like side-frame piece (a "C-shaped side-frame piece"), in some embodiments. In some embodiments, two such C-shaped side-frame pieces are included—namely, a right-side C-shaped side-frame piece and a left-side C-shaped side-frame piece.

In some embodiments, side legs of the present invention are provided that run parallel to the ground and their respective side's armrest component, thus forming a rectilinear, or approximately rectilinear, C- or U-shape with the vertically-oriented frame component and the armrest component, each being joined to the next at a perpendicular angle, or an approximately perpendicular angle. In some embodiments, the abbreviated side legs of the present invention may include, and/or be included within, the C-shaped side frame pieces of the chair.

As mentioned above, in some embodiments, a chair in accordance with the present invention includes a non-quadrilateral base including a third leg, at least partially centered between the two side legs (hereinafter, the "center leg"), and extending more greatly rearward than the two side legs, along a back length of the center leg. In some embodiments, the center leg is centered on a vertical plane bilaterally, symmetrically bisecting the chair.

As with the two side legs, in some embodiments, the center leg may include multiple component pieces of rectilinear dimensional lumber or other wood, joined in a similar manner.

In some embodiments, the center leg provides adequate support for the chair back, while increasing the positionability of the chair at an angle along walls and/or within corners.

The remainder of the center leg, other than its back length, (hereinafter, the "front portion of the center leg") may also be similar in shape and construction to the two side legs, in some embodiments. For example, in some such embodiments, as pictured, the front portion is also connected, at a perpendicular angle, with a front vertically-oriented frame component. In some embodiments, the front portion of the center leg extends to a horizontal position at or about the bottom of the front of the seat of the chair, as do the two side legs, as pictured above. However, in some embodiments, the front portion of the center leg may terminate mid-seat bottom, at or about a downward-facing surface of the seat bottom of the chair, for example.

In some embodiments, to better stabilize the chair, in some such embodiments, the legs and/or frame components are joined together by lateral supports, oriented parallel to the ground, and perpendicular to the legs or, in some embodiments, approximately parallel to the ground and approximately perpendicular to the legs or a portion or general orientation thereof. In some such embodiments, such lateral supports may be in the form of dowels, pins or rods. And, in some such embodiments, such dowels, pins or rods may be threaded, in some such embodiments allowing the use of threaded nuts to fasten them to the legs and/or other frame components. The number, frequency and arrangement of such lateral supports may vary widely in different embodiments of the invention, the embodiments specifically pictured or otherwise set forth in this application being only exemplary of the virtually unlimited numbers, frequencies and arrangements of such supports falling within the scope of the inventions set forth herein.

In some embodiments, a wide-bodied, slat-constructed chair in accordance with aspects of the present application includes a single, more robust, central chairback support. In some such embodiments, such a single, more robust, central chair back support is attached only to a center leg, such as any of the example single center legs as set forth in this application. In some embodiments, such a single central chairback support includes a thicker and/or stronger structural component than provided within the C-shaped side frame pieces, as discussed above.

In addition to example embodiments including an at least partially slat-constructed chair, and example embodiments including dimensional lumber, as set forth in this application, it should also be understood that various alternative forms of components and materials may also be used, in addition, or as an alternative, in various additional embodiments. For example, in various alternative embodiments, at least some components (such as a seat and/or a seatback of the chair) may be constructed of slats, panels or other forms of sub-components, made of metal, plastics or other polymers, and including fabric and/or padding, rather than, or in addition to, the slats, panels or dimensional lumber components specifically set forth in detail in this application. As another example, although embodiments showing rectilinear wooden slats and dimensional lumber components are pictured in this application, it should be understood that curved slats or panels, or curvilinear slats or panels, may be substituted for all or some those components, in additional, alternative embodiments, while still falling within the scope of the inventions set forth herein.

Canons of Construction

Where any term having multiple possible meanings, based on a reasonable interpretation, is set forth in a sentence, clause or other statement (a "statement") in this application, this application should be read as if each such reasonably possible meaning, significance and/or sense of each and every such term and statement is separately, conjunctively and alternatively set forth in additional alternative statement(s) thereafter.

It should also be understood that, for convenience and readability, this application may set forth particular pronouns and other linguistic qualifiers of various specific gender and number, but, where this occurs, this application should be read as if each other gender and number is separately, conjunctively and alternatively set forth in additional alternative statement(s) thereafter.

The embodiments set forth in detail in this application are to ease the reader's understanding of inventions set forth herein and, as such, are only examples of the virtually innumerable alternative embodiments falling within the scope of the application. No specific embodiment set forth in this application should be read as limiting the scope of any claimed inventions; the inventions of the present application are not limited to any particular preferred embodiment disclosed.

These and other aspects of the invention will be made clearer below, in other parts of this application. This Summary, the Abstract, and other parts of the application, are for ease of understanding only, and no part of this application should be read to limit the scope of the invention, whether or not it references matter also set forth in any other part.

BRIEF DESCRIPTION OF THE DRAWINGS

The features and advantages of example embodiments of the invention presented herein will become more apparent from the detailed description set forth below when taken in conjunction with the following drawings.

DETAILED DESCRIPTION OF THE INVENTION

Figure 1:
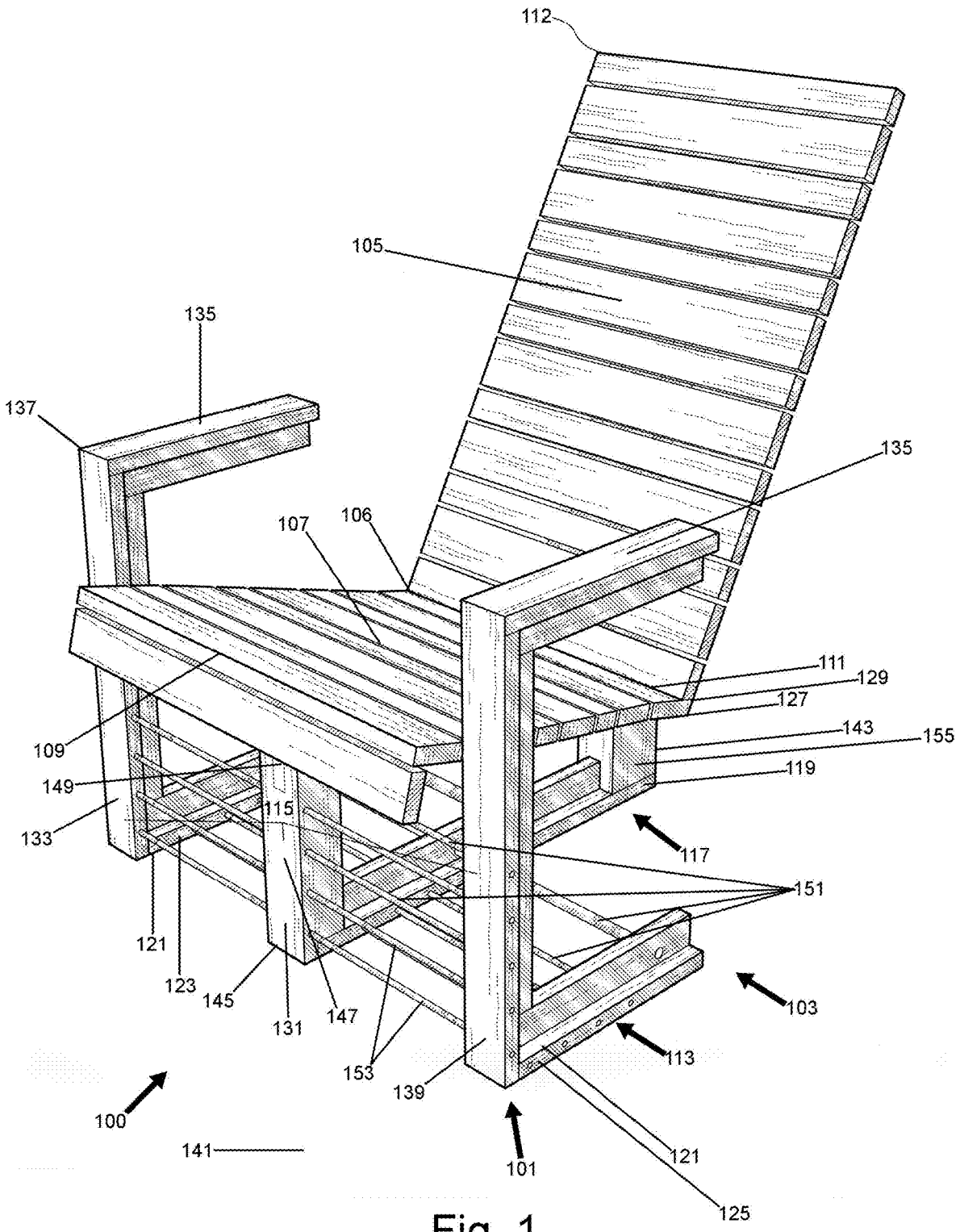
FIG. 1 is a three-quarter perspective drawing of an example wide-bodied, slat-constructed chair, in accordance with some embodiments of the present application.

The features and advantages of example embodiments of the invention presented herein are directed to new forms of wide-bodied, slat-constructed chairs, and methods for their use, which are now described herein. These and other aspects will become more apparent from the detailed description set forth below when taken in conjunction with the drawings. This description is not intended to limit the application to the embodiments presented herein, which are only examples of the virtually unlimited possible embodiments falling within the scope of the present application. In fact, after reading the following description, it will be apparent to one skilled in the relevant art(s) how to implement the following example embodiments in alternative embodiments, including any possible order, number or other arrangement of components and subcomponents (the following orders, components, subcomponents and/or relationships being non-limiting).

Embodiments of wide-bodied, slat-constructed chairs, and methods for their use in accordance with some aspects set forth in this Specification are depicted in FIGS. 1 through 37. The following is a list of defined components and/or aspects and reference numbers therefor, as used throughout the figures:

| Reference No. | Component |
|---|---|
| 100 | wide-bodied, slat-constructed chair |
| 101 | specialized support structure |
| 103 | non-quadrilateral base |
| 105 | reclined seatback |
| 106 | seat |
| 107 | seat bottom |
| 109 | higher front edge (of seat bottom 107) |
| 111 | lower back edge (of seat bottom 107) |
| 112 | reclined position (of reclined seatback 105) |
| 113 | specialized footprint (of non-quadrilateral base 103 and wide-bodied, slat-constructed chair 100) |
| 115 | generally triangular, three-legged base |
| 117 | rear area (of specialized support structure 101) |
| 119 | single rear leg |
| 121 | two side legs |
| 123 | right-hand side leg |
| 125 | left-hand side leg |
| 127 | lower, rearward corner (of seat 106) |
| 129 | lower, rearward edge (of seatback 105) |
| 131 | front (of three-legged base 115 and wide-bodied, slat-constructed chair 100) |
| 133 | front vertically-oriented frame component |
| 135 | wide-set, yet thinner-than-traditional armrests |
| 137 | right-side C-shaped side-frame piece |
| 139 | left-side C-shaped side-frame piece |
| 141 | ground or floor |
| 143 | back length (of single rear leg 119) |
| 145 | front portion (of single rear leg 119) |
| 147 | front vertically-oriented frame component |
| 149 | position (at bottom of the front of the seat bottom 107) |
| 151 | lateral supports |
| 153 | dowels, pins and/or rods |
| 155 | central chairback support |
| 201 | more greatly reclined position |
| 203 | top portion (of reclined seatback 105) |
| 205 | top edge (of reclined seatback 105) |
| 207 | new position (of top edge 205) |
| 301 | even more greatly reclined position (or reclined seatback 105) |
| 303 | even more greatly reclined position (of top edge 205) |
| 401 | top sides (of armrests 135) |
| 403 | upward-facing surfaces (of seat bottom 107) |
| 405 | user-facing surfaces (of reclined seatback 105) |
| 407 | initial position (of seat bottom front edge 109) |
| 501 | more forward position (of seat bottom front edge 109) |

-continued

| Reference No. | Component |
|---|---|
| 601 | even more forward position (of seat bottom front edge 109) |
| 701 | front sides (of side legs 121) |
| 703 | front-facing surfaces (of seat bottom 107) |
| 705 | lower edge (of seat bottom 107) |
| 1001 | rear sides (of side legs 121) |
| 1401 | more forward position (of seat bottom 107) |
| 1501 | even more forward position (of seat bottom 107) |
| 2501 | underside (of seat bottom 107) |
| 2503 | seat bottom channel |
| 2504 | right-hand side seat bottom channel guard |
| 2505 | seat bottom channel guards |
| 2506 | left-hand side seat bottom channel guard |
| 2507 | undergirding planks |
| 2509 | seat bottom slats |
| 2511 | pivoting block |
| 2512 | top plate |
| 2513 | angled and/or pivotable top portion (of single rear leg 119) |
| 2515 | channel movement stop |
| 2517 | seatback channel |
| 2519 | back side (of reclined seatback 105) |
| 2520 | right-hand side seatback channel guard |
| 2521 | seatback channel guards |
| 2522 | left-hand side seatback channel guard |
| 2523 | undergirding planks (fastened to back side 2519 of reclined seatback 105) |
| 2525 | seatback slats |
| 2526 | cap piece |
| 2527 | pivotally-mounted, rotating block |
| 2528 | fixed plate |
| 2701 | channel movement stop |
| 3101 | rails |
| 3103 | pivoting hinge |
| 3105 | axel hole |
| 3107 | dowel, pin or rod fastening hole |

FIG. 1 is a three-quarter perspective drawing of an example wide-bodied, slat-constructed chair 100 having a specialized support structure 101, including a non-quadrilateral base 103, among other aspects, in accordance with some embodiments of the present application. As with other wide-bodied, slat-constructed chairs discussed in this application, in some embodiments, wide-bodied, slat-constructed chair 100 includes a reclined seatback 105. In some embodiments, a seat 106 of wide-bodied, slat-constructed chair 100 includes both a seatback (such as seatback 105) and a seat bottom (such as seat bottom 107). And, as used in this application, with respect to chairs and chairbacks, "reclined" means that the chairback, such as reclined seatback 101, of a chair is leaned back, forming a greater than perpendicular angle with the seat bottom of (such as example seat bottom 107) of the wide-bodied, slat-constructed chair 100, and/or a ground or floor 141, on which wide-bodied, slat-constructed chair 100 is placed. Thus, unlike some other chairs, in some embodiments, wide-bodied, slat-constructed chair 100 includes a seatback (reclined seatback 105) that is not vertical or leaned forward. In addition, in some embodiments, wide-bodied, slat-constructed chair 100 does not include a seat that is oriented in an absolutely horizontal and flat position. Thus, as pictured, example seat bottom 107 is a sloped seat bottom, angled to create a higher front edge 109 of the seat bottom 107, and, correspondingly, a lower back edge 111, of seat bottom 107. As will be explained further below, in some embodiments, the reclined position 112 of reclined seatback 105, pictured, is one of one or more variably changeable reclined positions, each selectable by a user (e.g., to one or more greatly reclined position(s), in some embodiments.) In some embodiments, the reclined position 112, pictured, may be called a "minimally reclined"

position, meaning that reclined seatback 105 has been reclined to the least reclined angle possible, of an entire range of angles to which reclined seatback 105 may be reclined, in some embodiments.

In some embodiments, specialized support structure 101 and non-quadrilateral base 103 include a specialized footprint 113. As used in the present application, the "footprint" of a chair means the ground or floor area contacted and/or occupied by the chair when placed on a ground or a floor. For example, in some embodiments, non-quadrilateral base 103 includes, or is, a generally triangular, three-legged base 115, contacting and occupying a more limited floor area in comparison with a traditional Adirondack Chair. In particular, in some embodiments of such a specialized support structure, specialized footprint 113 is more limited in area, especially at the support structure 101's rear area 117, than the footprint of a traditional Adirondack Chair. Thus, for example, and as pictured, in some embodiments, specialized support structure 101 includes a single rear leg 119. In some embodiments, such a single rear leg is provided which does not extend rearward past or, in some embodiments, substantially past, the seatback of the chair. However, in some embodiments, by contrast, such a single rear leg is provided, part of which does extend rearward substantially past the seatback of the chair.

In some embodiments, specialized support structure 101 includes two side legs 121, including a right-hand side leg 123 and a left-hand side leg 125. In some such embodiments, the two side legs are "abbreviated," meaning that they do not extend, or do not substantially extend, into the rear area 117 of the support structure. For example, in some embodiments, the abbreviated two side legs 121 do not extend rearward past the horizontal position of the lower, rearward corner 127 of seat 106. As another example, in some embodiments, the two side legs 121 do not extend rearward, or, in some embodiments, they do not extend substantially rearward, past the lower, rearward edge 129 of the seatback 105 of wide-bodied, slat-constructed chair 100. In some embodiments, the abbreviated side legs are located at or about the middle and/or front 131 of three-legged base 115 and wide-bodied, slat-constructed chair 100.

In some embodiments, the abbreviated side legs of the present invention may be formed from a plurality of component pieces of wood. For example, in some embodiments, the abbreviated side legs may each be formed from at least two pieces of wood. In some such embodiments, at least some of the plurality of pieces of wood may be rectilinear dimensional wood pieces. In some embodiments, at least some of the plurality of pieces of wood may have a non-square (oblong) aspect or profile, even if they are rectilinear in some respect. In some such embodiments, at least some of the plurality of pieces of wood may have a non-square (oblong) profile. And, in some such embodiments, some or all of the plurality of pieces of wood may be joined (e.g., by fasteners or adhesives) in a perpendicular arrangement, with a smaller surface of one piece joined to part of a larger surface of another piece.

In some embodiments, each of the one or more of the abbreviated two side legs 121 are joined to, and/or integral with, a front vertically-oriented frame component, such as example front-vertically-oriented frame component 133, which, in turn, is joined to an armrest component, such as either of example wide-set, yet thinner-than-traditional armrests 135.

In some embodiments, the front vertically-oriented frame component 131 and/or the armrests 135 may each be similarly formed from a plurality of pieces of wood, having a rectilinear shape and being joined together in particular orientations, as discussed above with respect to the two side legs 121. In some embodiments, when joined together, the abbreviated two side legs 121, the vertically-oriented frame component 131 and the armrest component, may form a U-, C- or other arch-like side-frame piece (a "C-shaped side-frame piece"), in some embodiments. In some embodiments, two such C-shaped side-frame pieces are included—namely, a right-side C-shaped side-frame piece 137 and a left-side C-shaped side-frame piece 139.

In some embodiments, each of the two side legs 121 of the present invention are provided in an orientation running parallel to a ground or floor 141 on which the wide-bodied, slat-constructed chair 100 is placed, and also running parallel to their respective side's armrest component, thus forming a rectilinear C- or U-shape as joined with a vertically-oriented frame component and the armrest component, each such component being joined to an abutting component perpendicular angle (or an approximately perpendicular angle, in some embodiments). In some embodiments, the abbreviated two side legs 121 may include, and/or be included within, the C-shaped side frame pieces of the chair.

In some embodiments, wide-bodied, slat-constructed chair includes a non-quadrilateral base including the single rear leg 119, discussed above, which, in some embodiments, is at least partially centered between the two side legs, and extending more greatly rearward than the two side legs, along a back length 143 of the single rear leg 119. In some embodiments, the single rear leg 119 is centered on the vertical plane (not pictured) bilaterally, symmetrically bisecting the chair.

As with the two side legs, in some embodiments, the single rear leg 119 may include multiple component pieces of rectilinear dimensional wood, joined in a similar manner.

In some embodiments, the single rear leg 119 provides adequate support for the reclined seatback 105, while increasing the positionability of the chair at an angle along walls and/or within corners.

The remainder of the single rear leg 119, other than its back length 143, (namely, a front portion 145 of the single rear leg 119) may also be similar in shape and construction to the two side legs 121, in some embodiments. For example, in some such embodiments, as pictured, the front portion 145 is also connected, at a perpendicular angle, with a front vertically-oriented frame component 147. In some embodiments, the front portion 145 of the center leg extends to a position 149 at or about the bottom of the front of the seat bottom 107 of the chair. Similarly, the two side legs 121, as pictured above and/or the front vertically-oriented frame components attached or integral therewith, also may extend to two other positions at or about the bottom of the front of seat bottom 107, nearby position 149, in some embodiments (not pictured). In some embodiments, the front portion 145 of the single rear leg 119 may terminate mid-seat, at the bottom of the seat of the chair, for example (also not pictured in the present figure).

In some embodiments, to better stabilize the chair, the two side legs 121 and/or other frame components are joined together by lateral supports, such as the examples shown as lateral supports 151, oriented parallel to the ground, and perpendicular to the two side legs 121. In some such embodiments, such lateral supports 151 may be in the form of dowels, pins and/or rods, such as example dowels, pins and/or rods 153. And, in some such embodiments, such dowels, pins and/or rods may be threaded, allowing the use of threaded nuts to fasten them to the legs and/or other frame components. The number, frequency and arrangement of such lateral supports may vary widely in different embodiments of the invention, the embodiments specifically set forth and pictured in this application being only exemplary of the virtually unlimited numbers, frequencies and arrangements of such supports falling within the scope of the inventions set forth herein.

In some embodiments, a wide-bodied, slat-constructed chair in accordance with aspects of the present application includes a single, more robust, central chairback support 155. In some such embodiments, such a single, more robust, central chair back support 155 is attached only to a center leg, such as example single rear leg 119, or any of the other example single center legs as set forth in this application. In some embodiments, such a single central chairback support 155 includes a thicker and/or stronger structural component than provided within the C-shaped side frame pieces, as discussed above.

Figure 2:
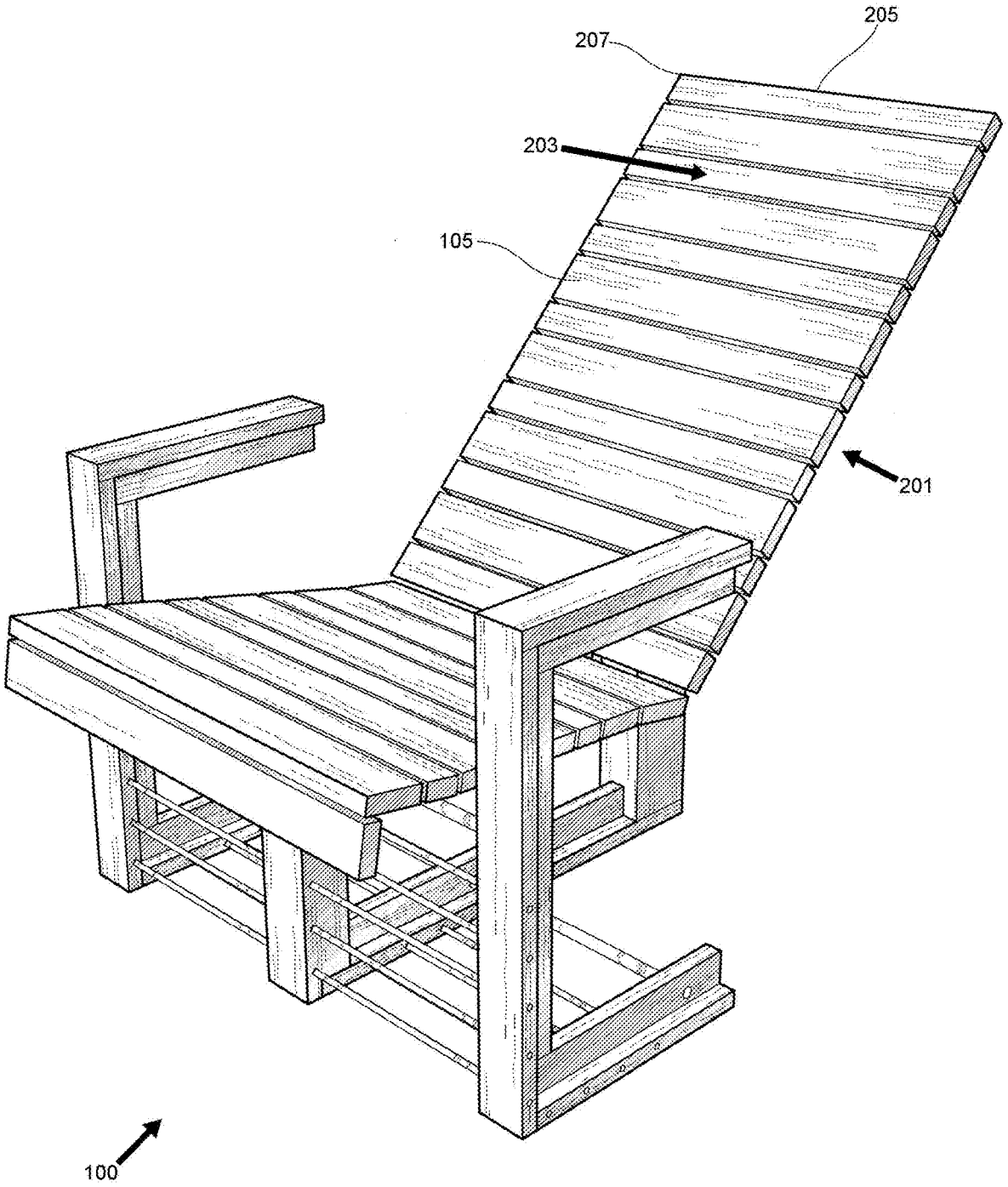
FIG. 2 is another three-quarter perspective drawing of the same example wide-bodied, slat-constructed chair as shown in FIG. 1, above, in a new, more greatly reclined configuration, in accordance with some additional embodiments of the present application.

FIG. 2 is another three-quarter perspective drawing of the same example wide-bodied, slat-constructed chair 100, having the same components as shown in FIG. 1, above, but showing the reclined seatback 105 in a new, more greatly reclined position 201, in accordance with some additional embodiments of the present application. In some embodiments, reclined seatback 105 may be reclined to any of a range of angles, any of which may be manually selected by a user of wide-bodied, slat-constructed chair 100. In some embodiments, any of those positions may be selected by the user simply shifting her or his back and pressing it against a top portion 203 of reclined seat back 105. As a result, as can now be seen in the present figure, a top edge 205 of reclined seatback 105 has shifted to a new position 207, rearward, increasing the angle at which reclined seatback 105 has been reclined. In some embodiments, a user may lock in such positions, with one or more positive stops (not pictured in the present figure) preventing, resisting and/or limiting changes to the angle at which the reclined seatback 105 is reclined. This new, more greatly reclined position 201 may be referred to as a "half-reclined" position, meaning that reclined seatback 105 of example wide-bodied, slat-constructed chair 100 has been reclined to an angle halfway between, or approximately halfway between, the entire range of angles to which reclined seatback 105 may be reclined, in some embodiments.

Figure 3:
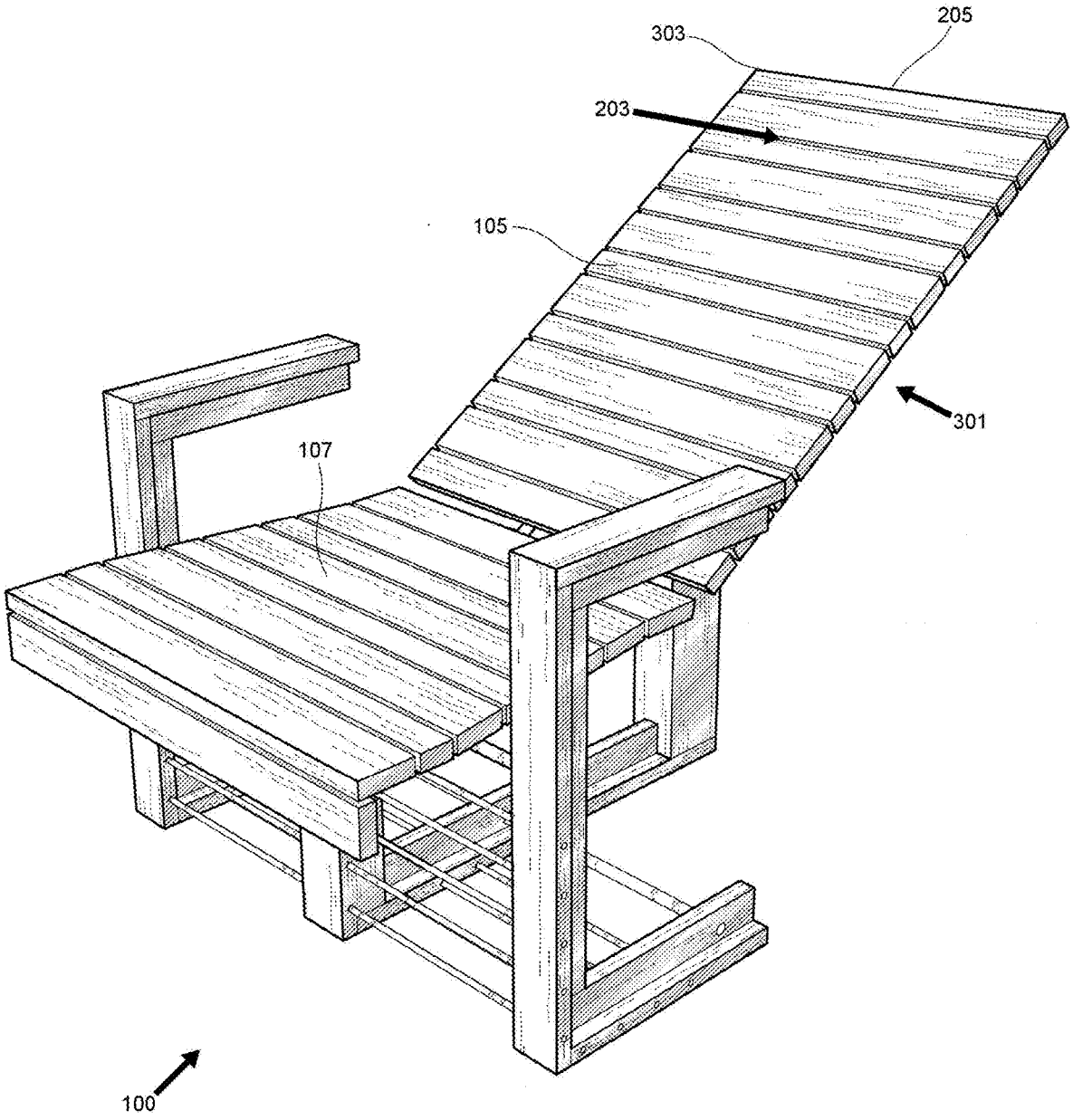
FIG. 3 is another three-quarter perspective drawing of the same example wide-bodied, slat-constructed chair as shown in FIGS. 1-2, above, in a new, even more greatly reclined configuration, in accordance with some additional embodiments of the present application.

FIG. 3 is another drawing of the same example wide-bodied, slat-constructed chair 100, having the same components as shown in FIGS. 1-2, above, but showing the reclined seatback 105 in a new, even more greatly reclined position 301, in accordance with some additional embodiments of the present application. In some embodiments, the user has shifting her or his back and pressed it against top portion 203 of reclined seat back 105 even more greatly. As a result, as can now be seen in the present figure, the top edge 205 of reclined seatback 205 has shifted to another new, even more greatly reclined position of reclined seatback 105, even more greatly rearward, increasing the angle at which reclined seatback 105 has been reclined. In some embodiments, as pictured, the reclined seatback 105 may be shifted to, or almost to, a horizontal orientation, as pictured. For example, in some embodiments, the reclined seatback 105 may form an angle with the seat bottom 107 at least approximately matching, or approaching 180 degrees. As another example, in some embodiments, the reclined seatback 105 may form an angle with the seat bottom 107 of approximately 170 degrees. As yet another example, in some embodiments, the reclined seatback 105 may form an angle with the seat bottom 107 of approximately 160 degrees.

Figure 4:
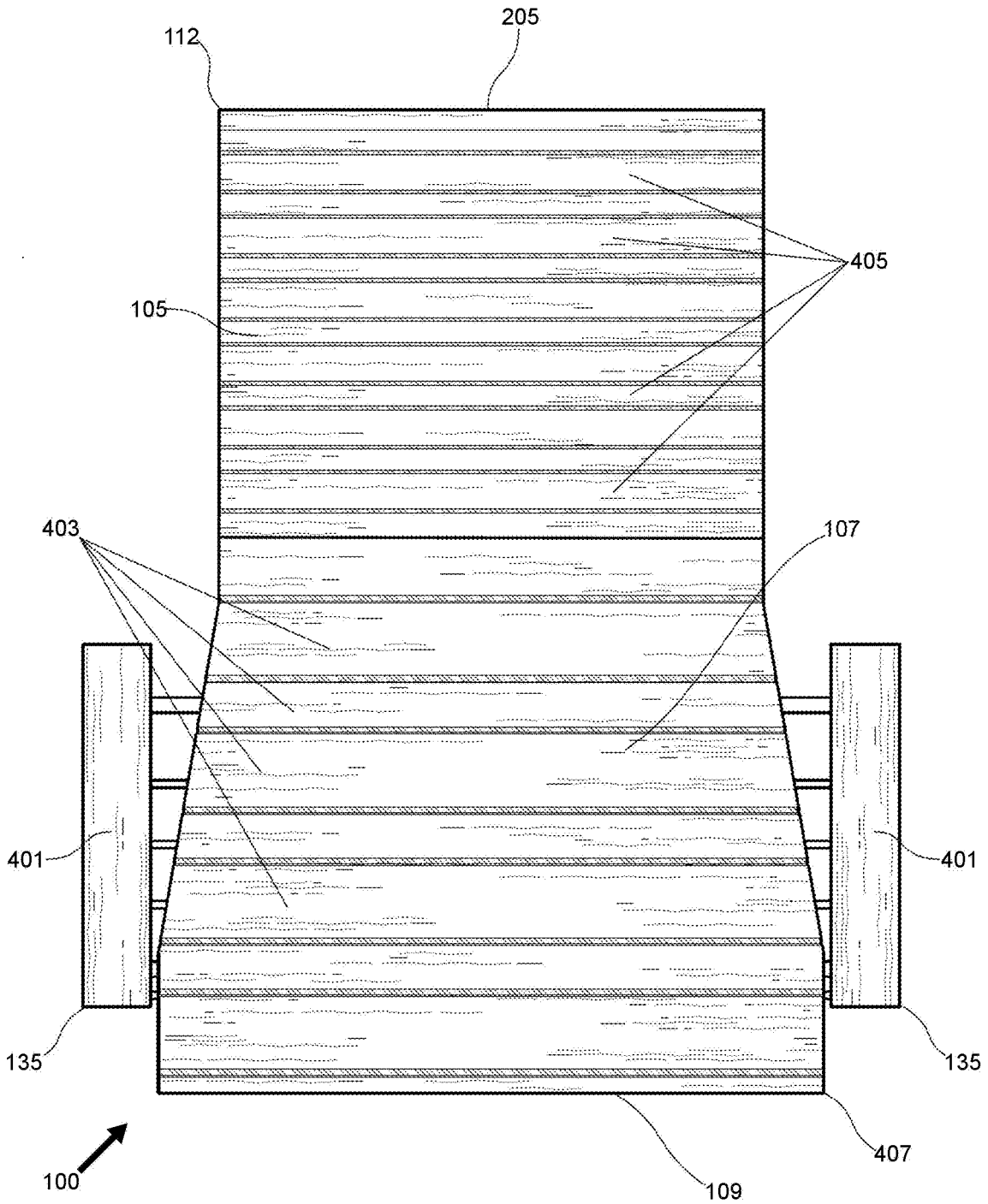
FIG. 4 is a top view drawing of the same example wide-bodied, slat-constructed chair as shown in FIGS. 1-3, above, in accordance with some additional embodiments of the present application.

FIG. 4 is a top view drawing of the same example wide-bodied, slat-constructed chair 100, having the same components as shown in FIGS. 1-3, above, in accordance with some additional embodiments of the present application. As shown in the perspective of the drawing, the reclined seatback 105 is in the same (minimally) reclined position 112, as pictured for FIG. 1, discussed above. From the top view perspective, the top sides 401 of example wide-set, yet thinner-than-traditional armrests 135 can be seen, as well as the upward-facing surfaces, such as example upward-facing surfaces 403, of the seat bottom 107, and the user-facing surfaces, such as example user-facing surfaces 405, of reclined seatback 105. However, as discussed above, the angles and positions of seat bottom 107 and reclined seatback 105 are user-variable, in some embodiments. Thus, for example the top edge 205 of the reclined seatback 105, shown in a minimally reclined position, and the front edge 109 of the seat bottom 107, shown in an initial position 407 caused by the minimally reclined position 112 of seatback 105, may change in position, as a result of a user altering the amount of reclination of reclined seatback 105, in some embodiments, as will be discussed further, below.

Figure 5:
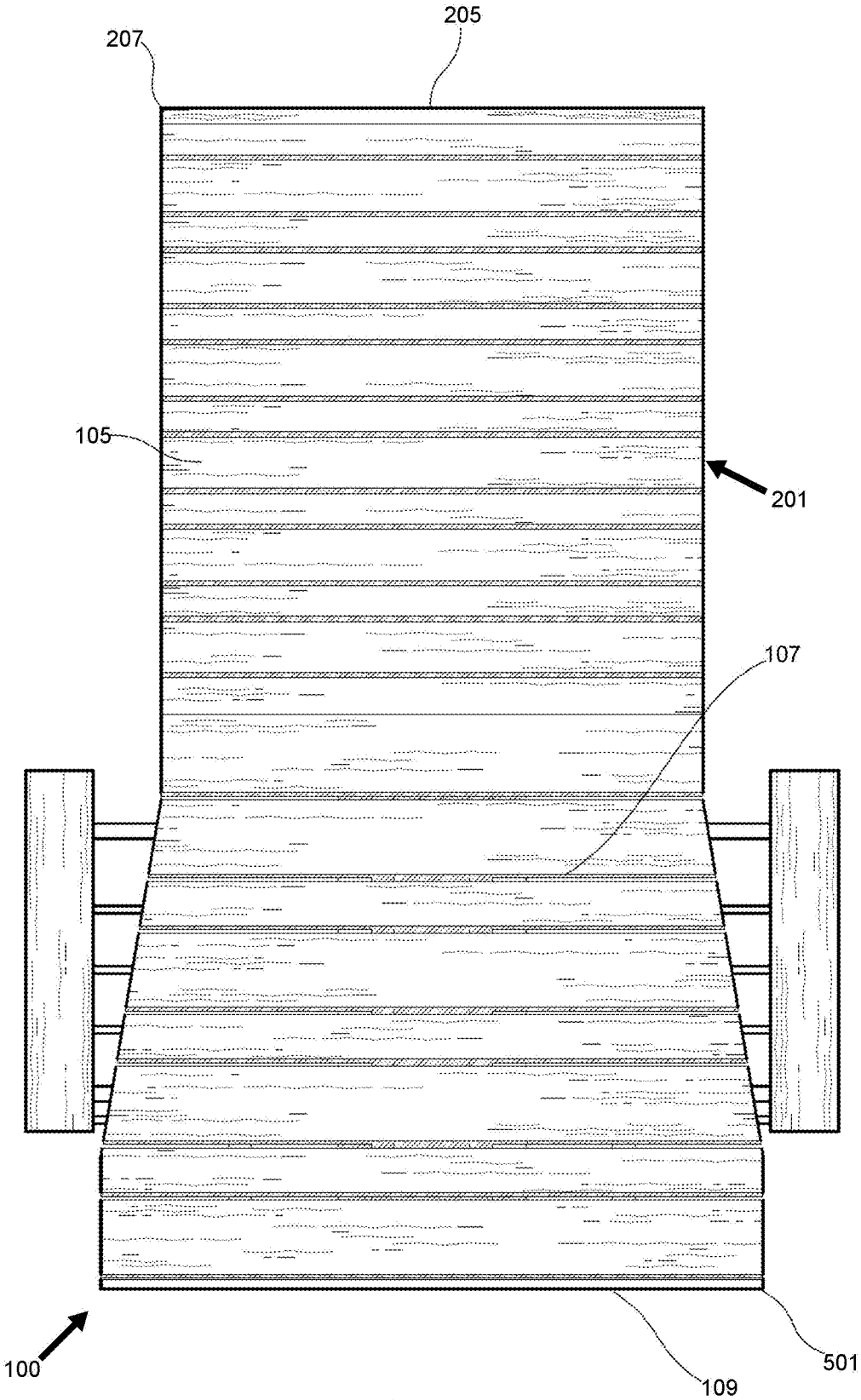
FIG. 5 is another top view drawing of the same example wide-bodied, slat-constructed chair as shown in FIGS. 1-4, above, in accordance with some additional embodiments of the present application.

FIG. 5 is another top view drawing of the same example wide-bodied, slat-constructed chair 100, having the same components as shown in FIGS. 1-4, above, in accordance with some additional embodiments of the present application. As shown in the perspective of the drawing, the reclined seatback 105 is in the same more greatly reclined position 201 as pictured for FIG. 2, discussed above. In some embodiments, the more greatly reclined position 201 is a half-reclined position, meaning that the chair has been reclined to an angle about halfway between the minimum and maximum angle, based on its physical limits. Thus, for example the top edge 205 of the reclined seatback 105, is shown in the more greatly reclined position 207, and the front edge 109 of the seat bottom 107, is shown in a more forward position 501, caused by the more greatly reclined position 207 of the reclined seatback 105, as a result of a user altering the amount of reclination of reclined seatback 105, in some embodiments.

Figure 6:
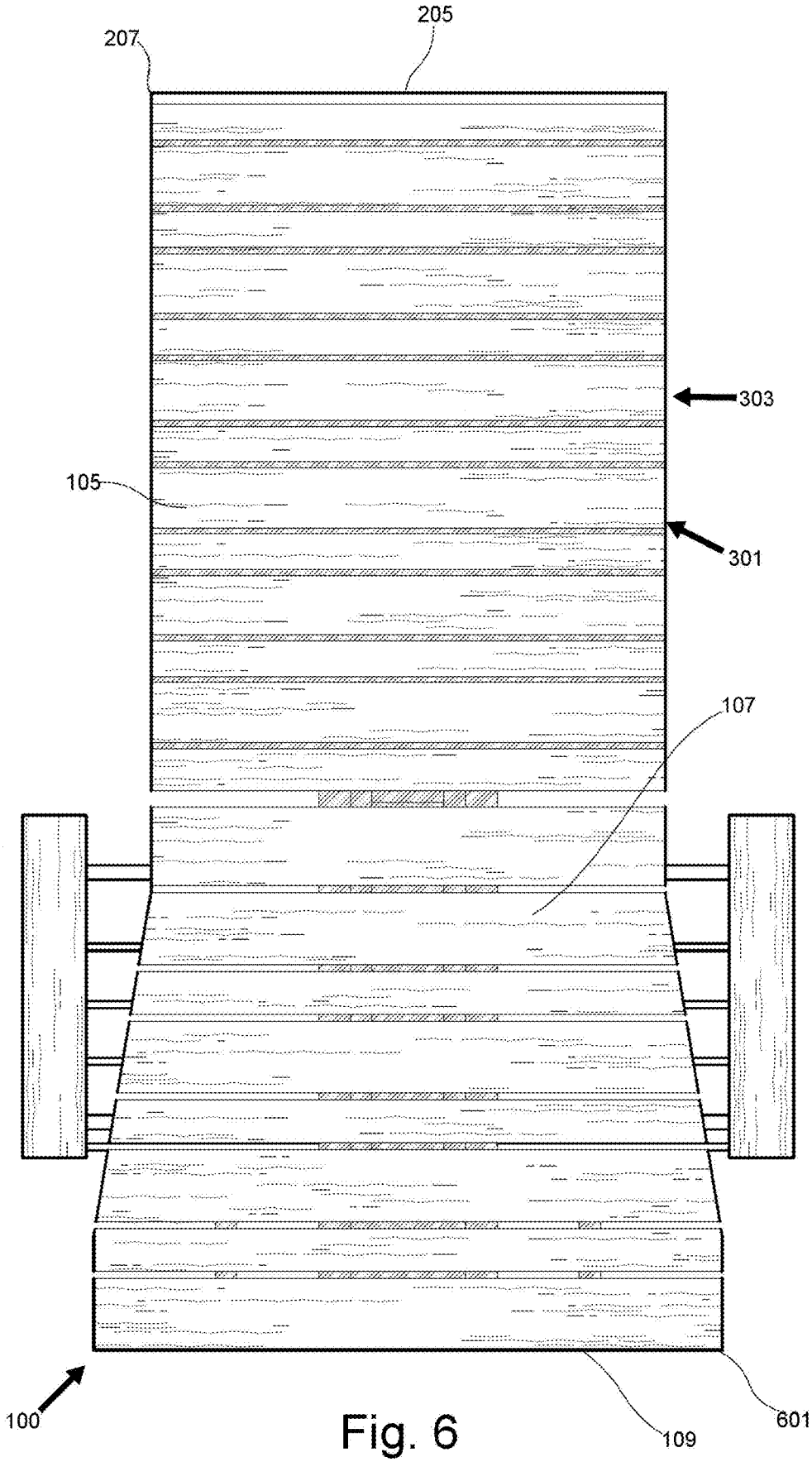
FIG. 6 is another top view drawing of the same example wide-bodied, slat-constructed chair as shown in FIGS. 1-5, above, in accordance with some additional embodiments of the present application.

FIG. 6 is another top view drawing of the same example wide-bodied, slat-constructed chair 100, having the same components as shown in FIGS. 1-5, above, in accordance with some additional embodiments of the present application. As shown in the perspective of the drawing, the reclined seatback 105 is in the even more greatly reclined position 301 as pictured for FIG. 3, discussed above. In some embodiments, the even more greatly reclined position 301 is a fully reclined position, meaning that the chair has been reclined to its maximum physical limits, by a user. Thus, for example the top edge 205 of the reclined seatback 105, is shown in the even more greatly reclined, new position 303, and the front edge 109 of the seat bottom 107, is shown in an even more forward position 601, caused by the more greatly reclined position 207 of the reclined seatback 105, as a result of a user altering the amount of reclination of reclined seatback 105, in some embodiments.

Figure 7:
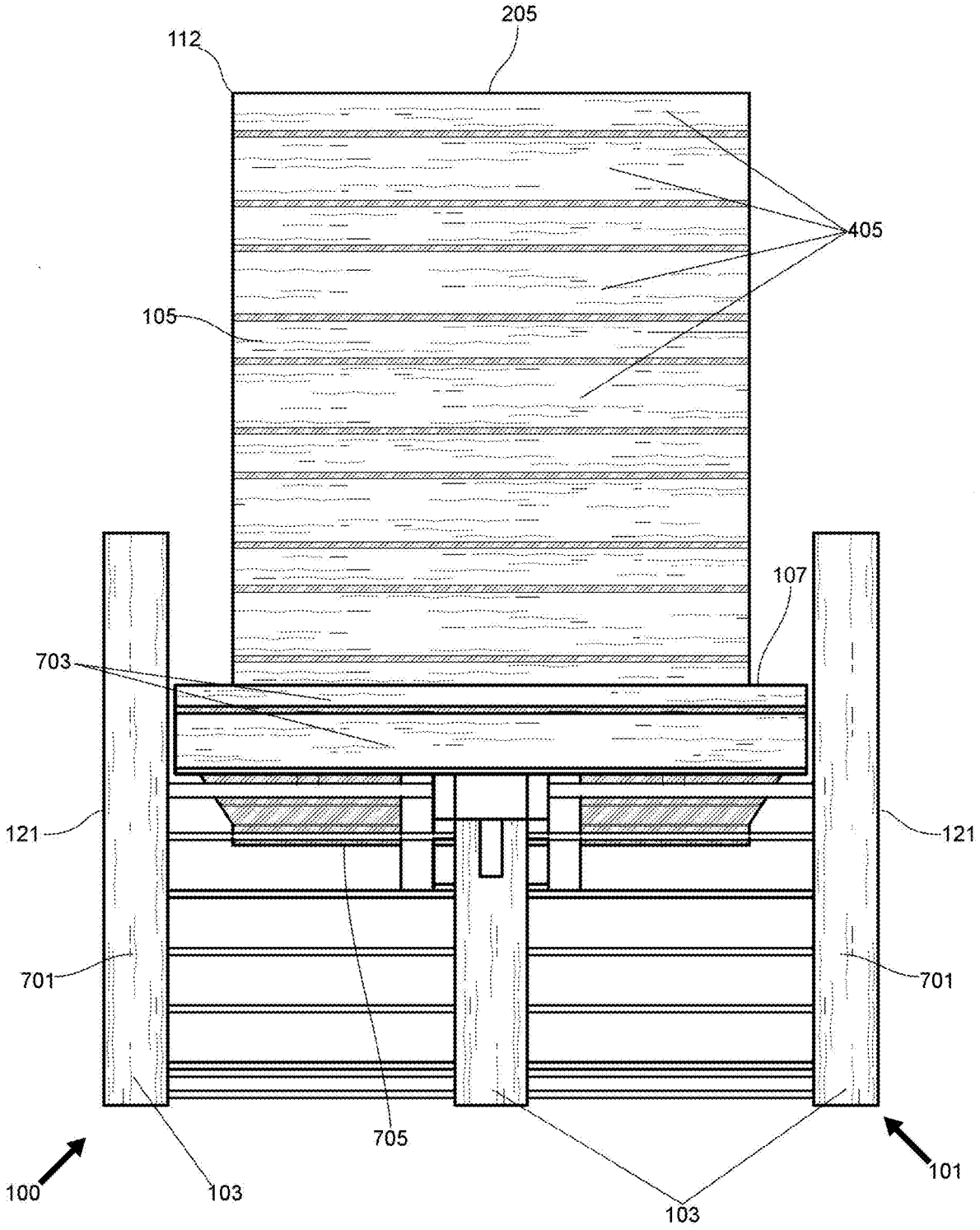
FIG. 7 is front view drawing of the same example wide-bodied, slat-constructed chair as shown in FIGS. 1-6, above, in accordance with some additional embodiments of the present application.

FIG. 7 is front view drawing of the same example wide-bodied, slat-constructed chair 100, having the same components as shown in FIGS. 1-6, above, in accordance with some additional embodiments of the present application. As shown in the perspective of the drawing, the reclined seatback 105 is in the same reclined position 112 as pictured for FIG. 1, discussed above. From the front view perspective, the front sides 701 of example two side legs 121 can be seen, as well as the front-facing surfaces 703 and lower edge 705 of the seat bottom 107, and the user-facing surfaces, such as example user-facing surfaces 405, of reclined seatback 105. However, as discussed above, the angles and positions of seat bottom 107 and reclined seatback 105 are user-variable, in some embodiments. Thus, for example, the top edge 205 of the reclined seatback 105, is shown in the same minimally reclined position caused by the minimally reclined position 112 of the reclined seatback 105. However, these positions may change, as a result of a user altering the amount of reclination of reclined seatback 105, in some embodiments, as discussed herein. However, some components of wide-bodied, slat-constructed chair 100 do not generally alter their position, even where a user alters the angle of reclination of reclined seatback 105, including components of the specialized support structure 101, including a non-quadrilateral base 103.

Figure 8:
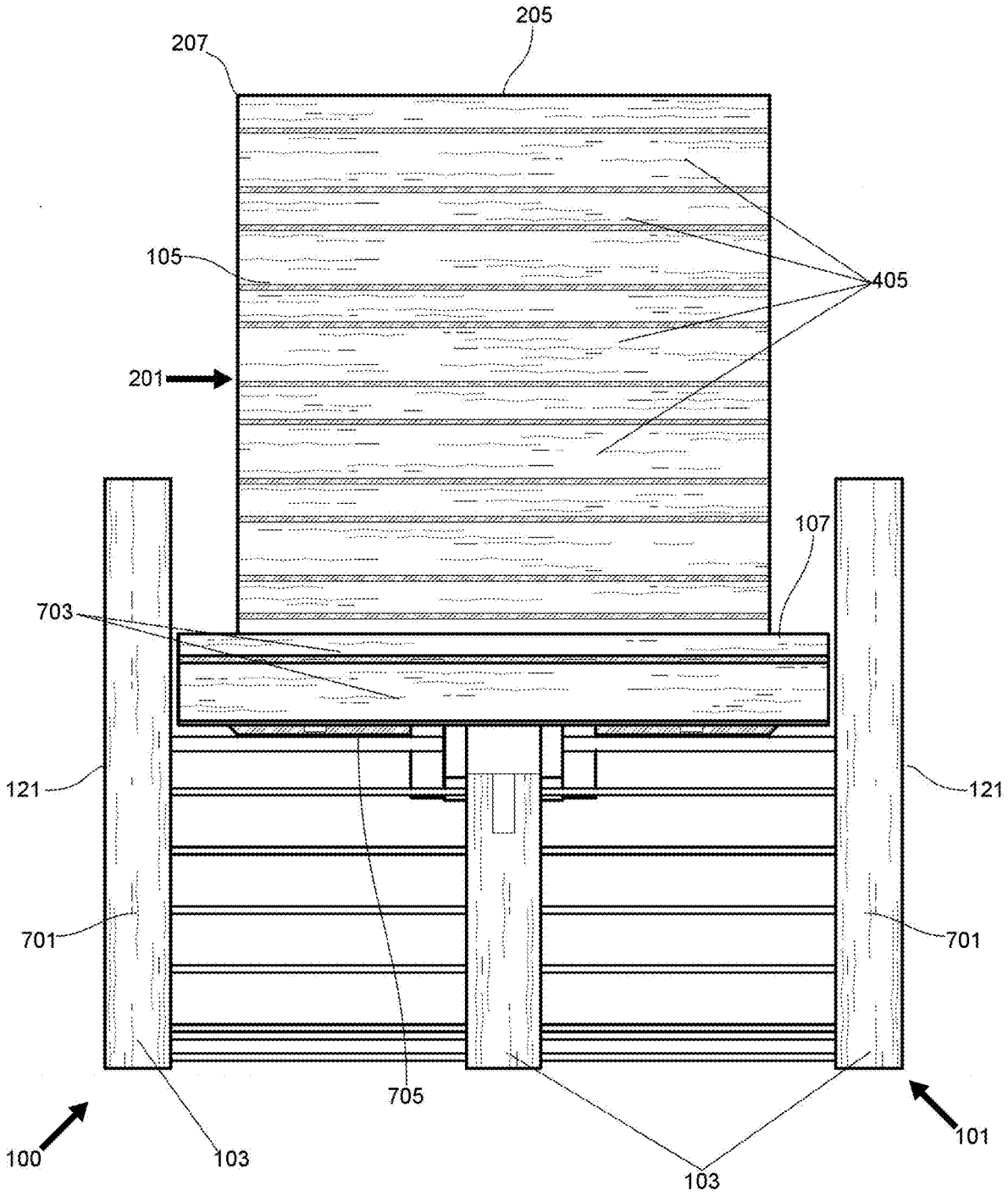
FIG. 8 is front view drawing of the same example wide-bodied, slat-constructed chair as shown in FIGS. 1-7, above, in accordance with some additional embodiments of the present application.

FIG. 8 is front view drawing of the same example wide-bodied, slat-constructed chair 100, having the same components as shown in FIGS. 1-7, above, in accordance with some additional embodiments of the present application. As shown in the perspective of the drawing, the reclined seatback 105 is in the same more greatly reclined position 201 as pictured for FIG. 2, discussed above. In some embodiments, the more greatly reclined position 201 is a half-reclined position, meaning that the chair has been reclined to an angle about halfway between the minimum and maximum angle, based on its physical limits.

As a result, as can now be seen in the present figure, top edge 205 has shifted to a new position 207, as has lower edge 705 of the seat bottom 107, increasing the angle at which reclined seatback 105 has been reclined. However, some components of wide-bodied, slat-constructed chair 100 have not generally altered their position, even though a user has altered the angle of reclination of reclined seatback 105, including components of the specialized support structure 101, including a non-quadrilateral base 103.

Figure 9:
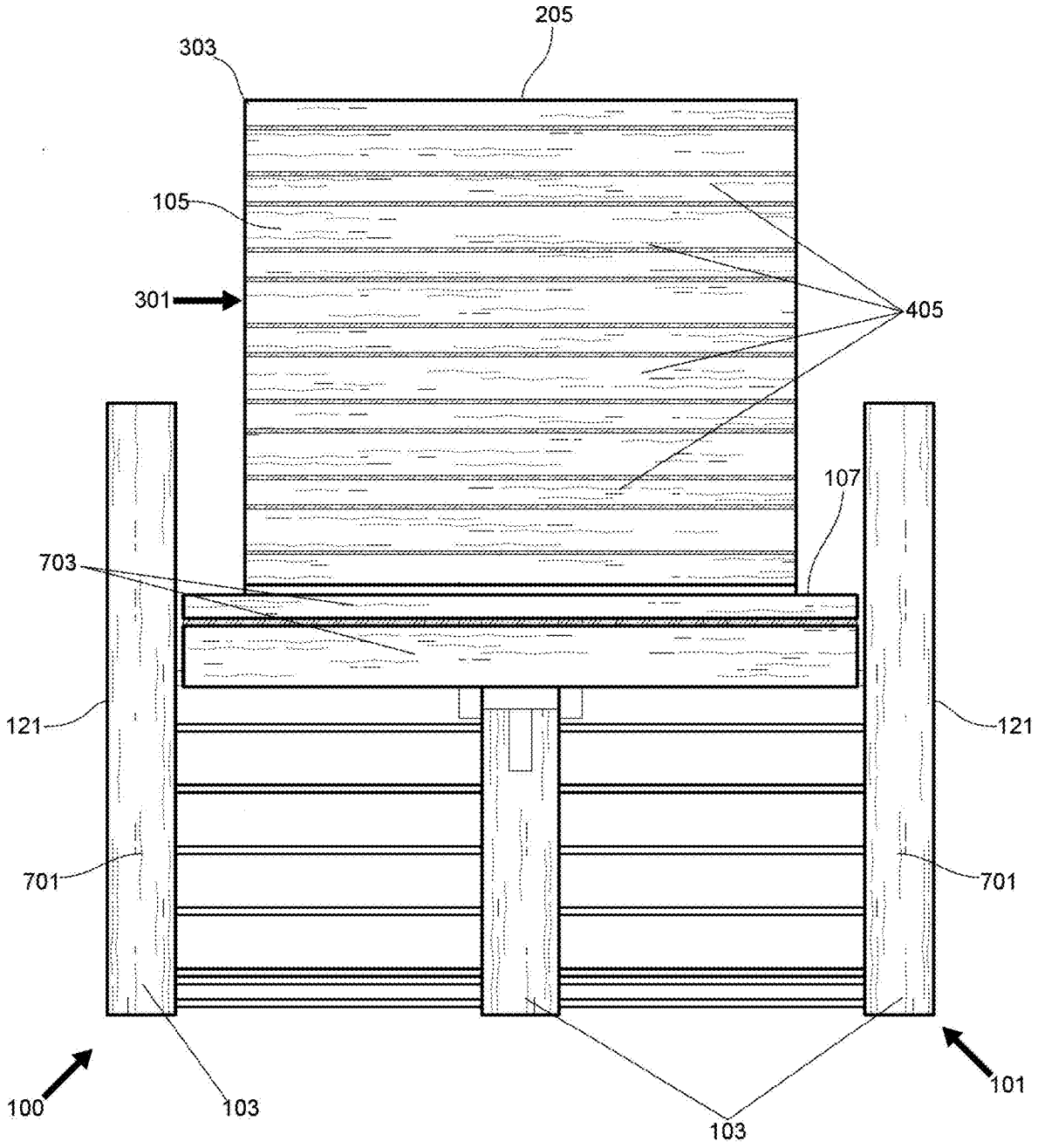
FIG. 9 is front view drawing of the same example wide-bodied, slat-constructed chair as shown in FIGS. 1-8, above, in accordance with some additional embodiments of the present application.

FIG. 9 is front view drawing of the same example wide-bodied, slat-constructed chair 100, having the same components as shown in FIGS. 1-8, above, in accordance with some additional embodiments of the present application. As shown in the perspective of the drawing, the reclined seatback 105 is in the even more greatly reclined position 301 as pictured for FIG. 3, discussed above. In some embodiments, the even more greatly reclined position 301 is a fully reclined position, meaning that the chair has been reclined to its maximum physical limits.

As a result, as can now be seen in the present figure, top edge 205 has shifted to a new position 303, even lower, and lower edge 705 of the seat bottom 107, has shifted out of view, and the reclined seatback 105 is shown in the even more greatly reclined, new position 301, as discussed above.

However, as before, some components of wide-bodied, slat-constructed chair 100 have not generally altered their position, even though a user has altered the angle of reclination of reclined seatback 105, including components of the specialized support structure 101, including a non-quadrilateral base 103.

Figure 10:
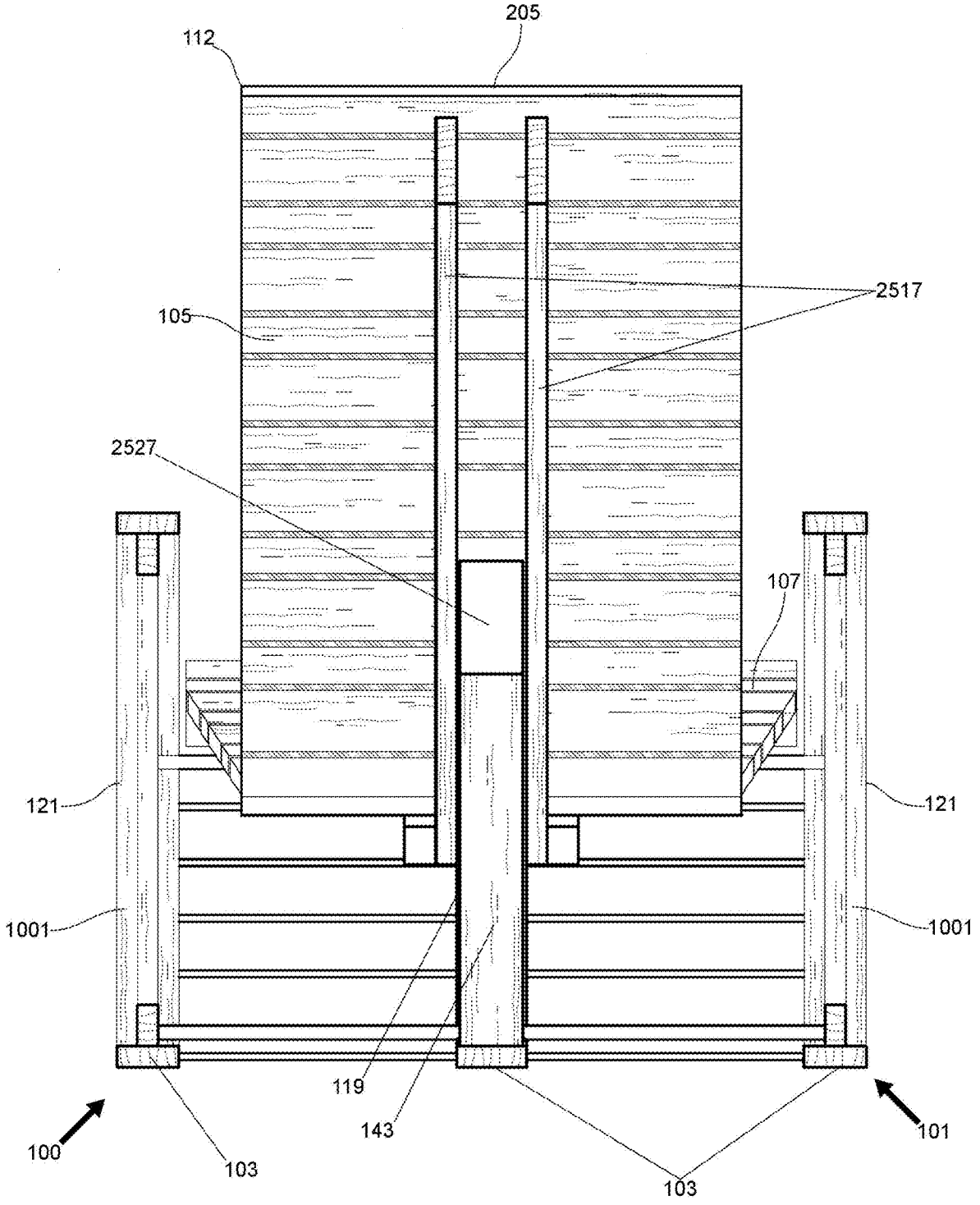
FIG. 10 is a rear view drawing of the same example wide-bodied, slat-constructed chair as shown in FIGS. 1-9, above, in accordance with some additional embodiments of the present application.

FIG. 10 is a rear view drawing of the same example wide-bodied, slat-constructed chair 100, having the same components as shown in FIGS. 1-9, above, in accordance with some additional embodiments of the present application. As shown in the perspective of the drawing, the reclined seatback 105 is in the same position 112 as pictured for FIG. 1, discussed above.

A number of components are now more visible from the perspective of the figure, including a seatback channel 2517 in which a pivotally-mounted, rotating block 2527 is provided, attached to and/or integral with a top portion of the back length 143 of single rear leg 119. These and other related aspects will be discussed in greater detail below. From the rear view perspective, the rear sides 1001 of example two side legs 121 can also now be seen.

As discussed above, the angles and positions of seat bottom 107 and reclined seatback 105 are user-variable, in some embodiments. Thus, for example, the top edge 205 of the reclined seatback 105, is shown in the same minimally reclined position caused by the minimally reclined position 112 of the reclined seatback 105. However, these positions may change, as a result of a user altering the amount of reclination of reclined seatback 105, in some embodiments, as discussed herein. However, as discussed above, some components of wide-bodied, slat-constructed chair 100 do not generally alter their position, even where a user alters the angle of reclination of reclined seatback 105, including components of the specialized support structure 101, including a non-quadrilateral base 103.

Figure 11:
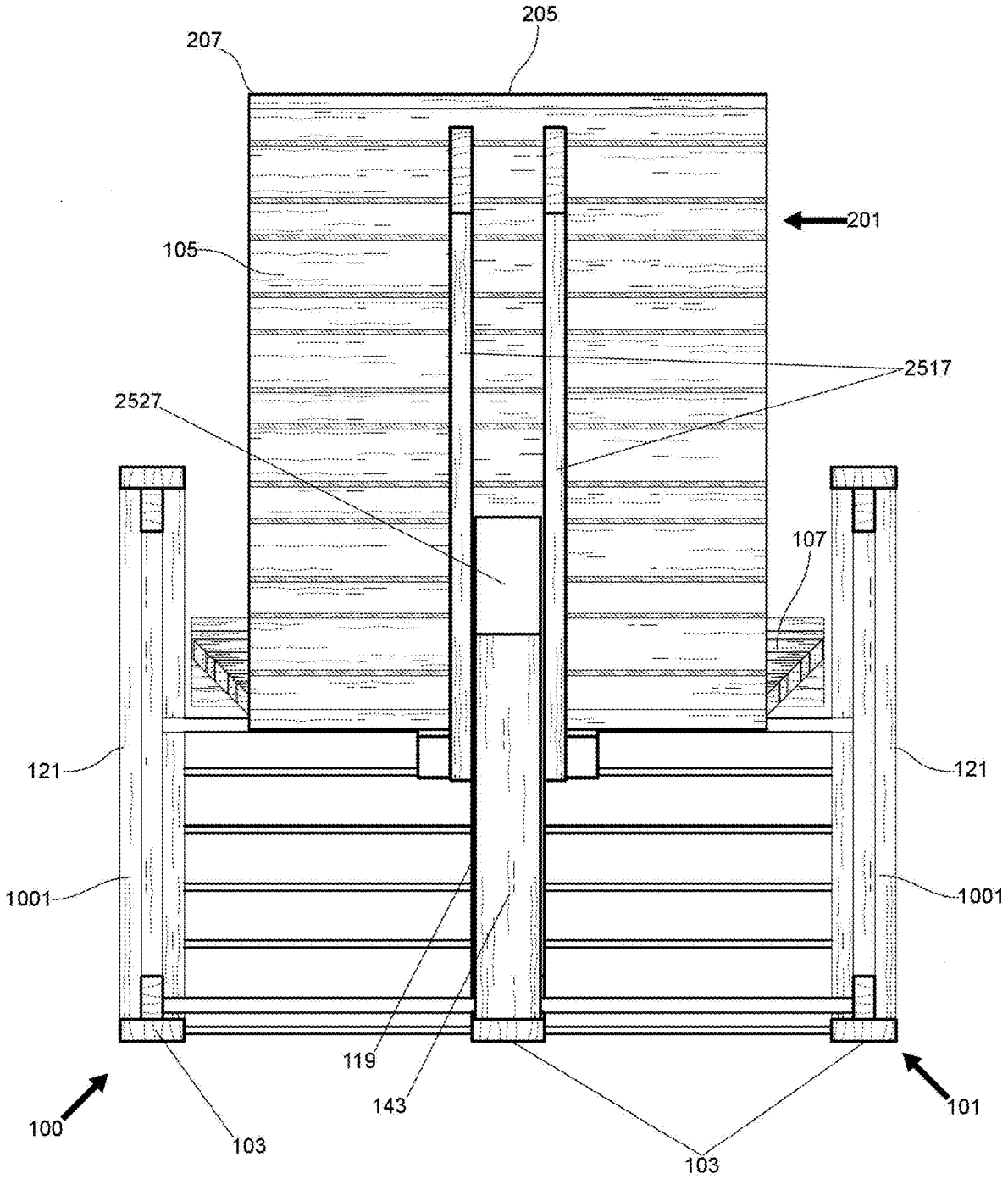
FIG. 11 is another rear view drawing of the same example wide-bodied, slat-constructed chair as shown in FIGS. 1-10, above, in accordance with some additional embodiments of the present application.

FIG. 11 is another rear view drawing of the same example wide-bodied, slat-constructed chair 100, having the same components as shown in FIGS. 1-10, above, in accordance with some additional embodiments of the present application. As shown from the point of view of the drawing, the reclined seatback 105 is in the same more greatly reclined position 201 as pictured for FIG. 2, discussed above. In some embodiments, the more greatly reclined position 201 is a half-reclined position, meaning that the chair has been reclined to an angle about halfway between the minimum and maximum angle, based on its physical limits.

As a result, as can now be seen in the present figure, top edge 205 has shifted to a new position 207, lower down, increasing the angle at which reclined seatback 105 has been reclined. Aiding reclined seatback 105 in so reclining, pivotally-mounted, rotating block 2527 has pivoted within seatback channel 2517.

However, some components of wide-bodied, slat-constructed chair 100 have not generally altered their position, even though a user has altered the angle of reclination of reclined seatback 105, including components of the specialized support structure 101, including a non-quadrilateral base 103.

Figure 12:
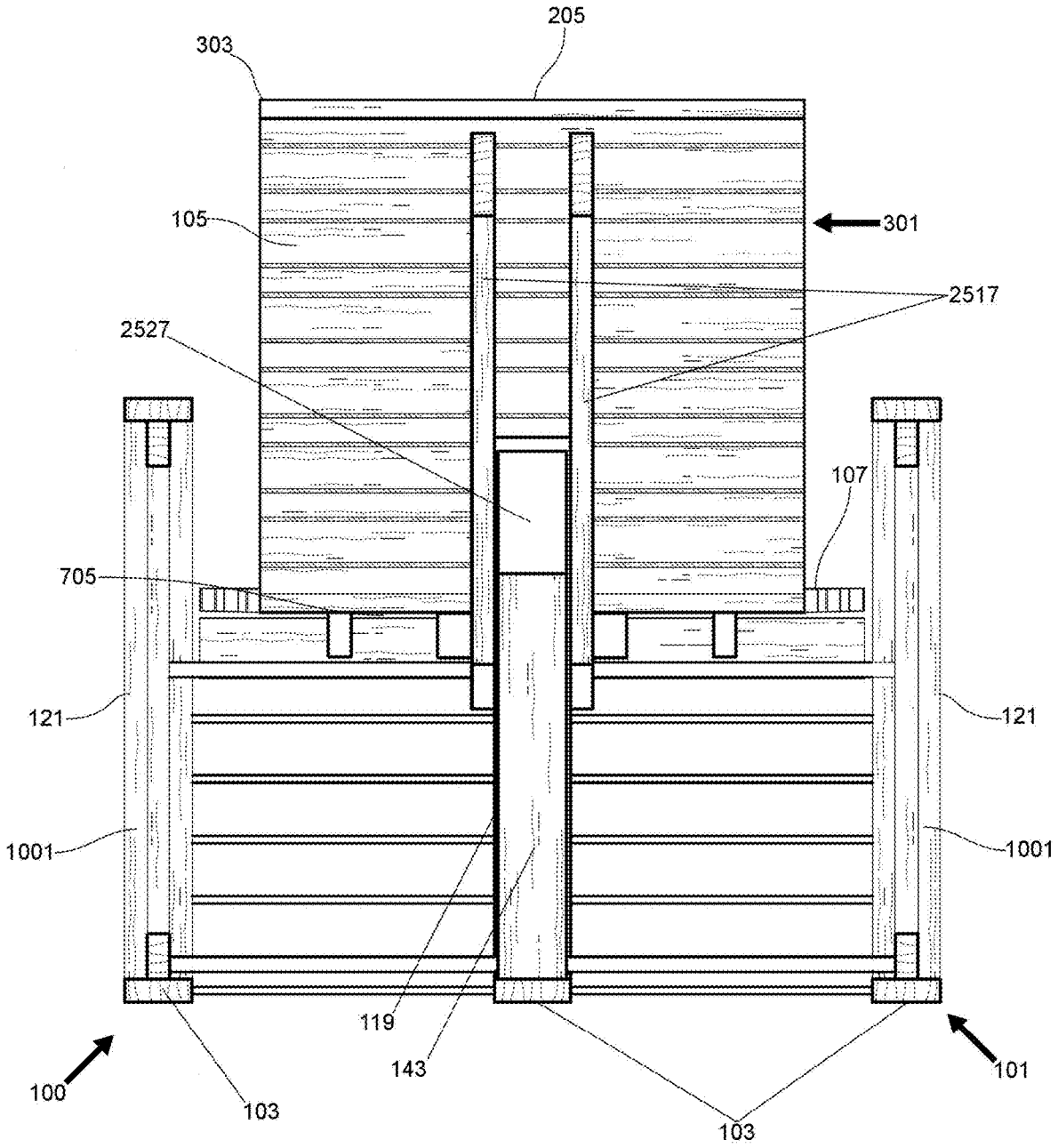
FIG. 12 is another rear view drawing of the same example wide-bodied, slat-constructed chair as shown in FIGS. 1-11, above, in accordance with some additional embodiments of the present application.

FIG. 12 is another rear view drawing of the same example wide-bodied, slat-constructed chair 100, having the same components as shown in FIGS. 1-11, above, in accordance with some additional embodiments of the present application. As shown in the perspective of the drawing, the reclined seatback 105 is in the even more greatly reclined position 301 as pictured for FIG. 3, discussed above. In some embodiments, the even more greatly reclined position 301 is a fully reclined position, meaning that the chair has been reclined to its maximum physical limits.

As a result, as can now be seen in the present figure, top edge 205 has shifted to a new position 303, even lower, and lower edge 705 of the seat bottom 107, has shifted upward, and the reclined seatback 105 is shown in the even more greatly reclined, new position 301, as discussed above.

However, as before, some components of wide-bodied, slat-constructed chair 100 have not generally altered their position, even though a user has altered the angle of reclination of reclined seatback 105, including components of the specialized support structure 101, including a non-quadrilateral base 103.

Figure 13:
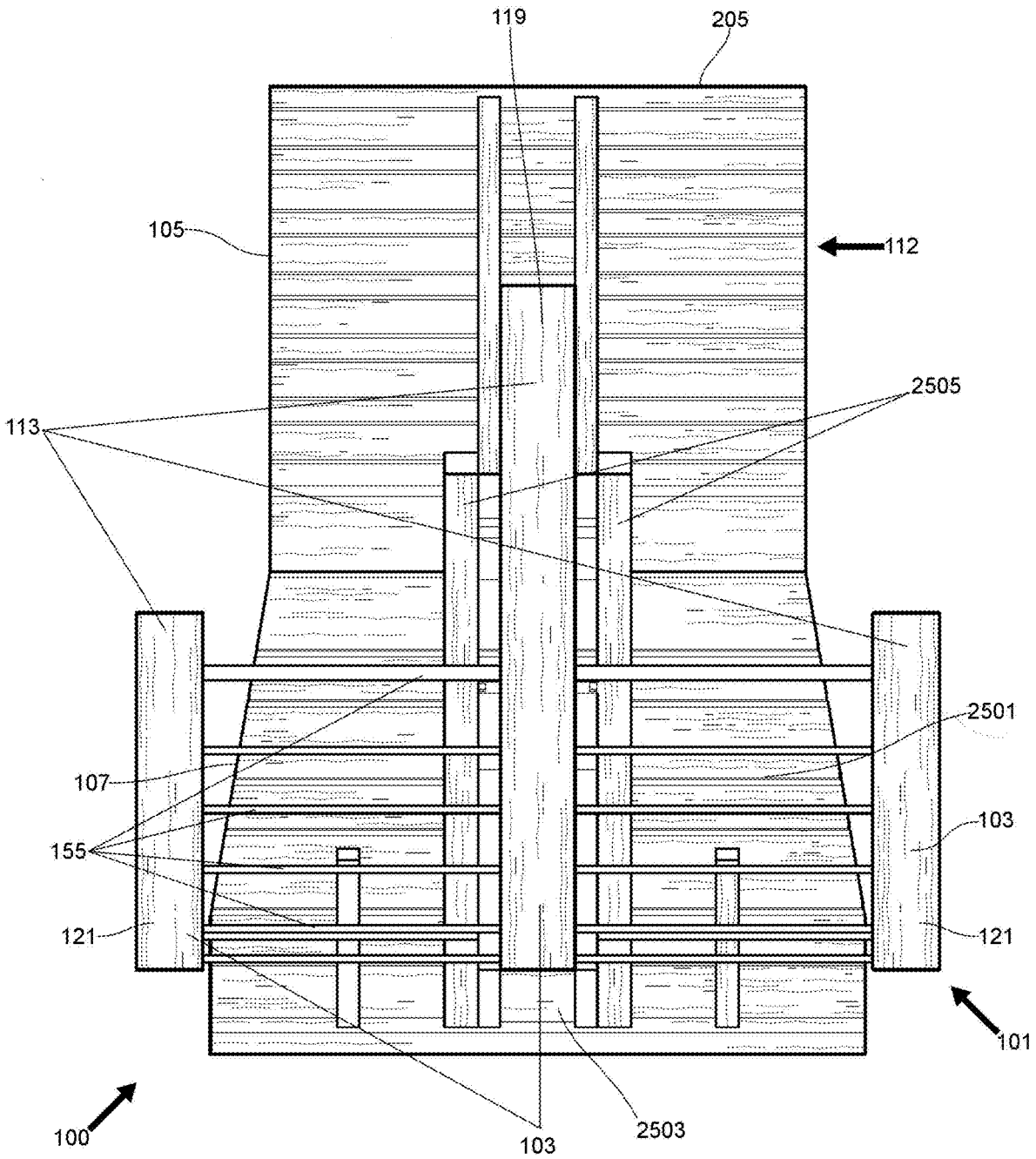
FIG. 13 is a bottom view drawing of the same example wide-bodied, slat-constructed chair as shown in FIGS. 1-12, above, in accordance with some additional embodiments of the present application.

FIG. 13 is a bottom view drawing of the same example wide-bodied, slat-constructed chair 100, having the same components as shown in FIGS. 1-12, above, in accordance with some additional embodiments of the present application. As shown in the perspective of the drawing, the reclined seatback 105 is in the same position 112 as pictured for FIG. 1, discussed above. But from the bottom view perspective of the drawing, some aspects of some components of the wide-bodied, slat-constructed chair 100 can now be seen with an unobstructed view, such as aspects of the specialized footprint 113 of the non-quadrilateral base 103, and specialized support structure 101 generally. In addition, now visible underside 2501 of seat bottom 107 and a seat bottom channel 2503, formed from two seat bottom channel guards 2505, can now be seen, each of which will be discussed in greater detail, below, in reference to other figures.

As discussed above, the angles and positions of seat bottom 107 and reclined seatback 105 are user-variable, in some embodiments. Thus, for example, the top edge 205 of the reclined seatback 105, is shown in the same minimally reclined position caused by the minimally reclined position 112 of the reclined seatback 105. However, these positions may change, as a result of a user altering the amount of reclination of reclined seatback 105, in some embodiments, as discussed herein.

As discussed above, some components of wide-bodied, slat-constructed chair 100 do not generally alter their position, even where a user alters the angle of reclination of reclined seatback 105, including components of the specialized support structure 101, including a non-quadrilateral base 103.

Also more clearly visible in the bottom view perspective are dowels, pins and/or rods, such as the examples shown as dowels, pins and/or rods 153, which, as discussed above, serve as lateral supports and decorative elements, in some embodiments, fastening together the two side legs 121, single rear leg 119, and other frame components of the specialized support structure 101. In some such embodiments, such dowels, pins or rods may be threaded, allowing the use of threaded nuts to fasten them to such legs and/or other frame components. The number, frequency and arrangement of such lateral supports may vary widely in different embodiments of the invention, the embodiments specifically set forth and pictured in this application being only exemplary of the virtually unlimited numbers, frequencies and arrangements of such supports falling within the scope of the inventions set forth herein.

Figure 14:
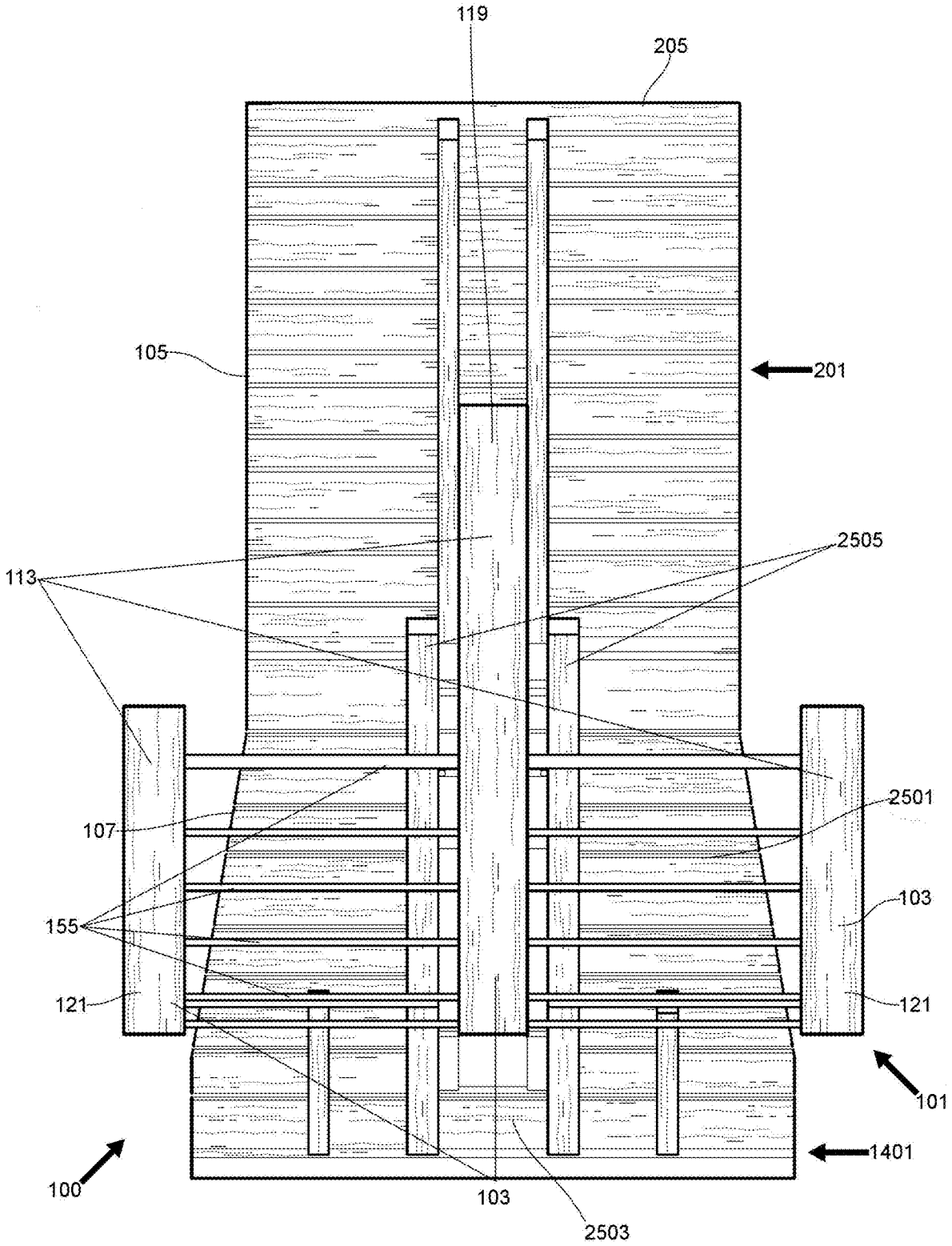
FIG. 14 is another bottom view drawing of the same example wide-bodied, slat-constructed chair as shown in FIGS. 1-13, above, in accordance with some additional embodiments of the present application.

FIG. 14 is another bottom view drawing of the same example wide-bodied, slat-constructed chair 100, having the same components as shown in FIGS. 1-13, above, in accordance with some additional embodiments of the present application. As shown in the perspective of the drawing, the reclined seatback 105 is in the same more greatly reclined position 201 as pictured for FIG. 2, discussed above. And seat bottom 107 is now shown in a more forward position 1401 (downward, in the perspective of the figure), corresponding with that more greatly reclined position 201 of seatback 105. To attain that more forward position 1401, in some embodiments, single rear leg 119 slid backwards within the seat bottom channel 2503, and against the two seat bottom channel guards 2505, and now appears in a more rearward position (upward, in the perspective of the figure) relative to the seat bottom 107.

In some embodiments, the more greatly reclined position 201 is a half-reclined position, meaning that the chair has been reclined to an angle about halfway between the minimum and maximum angle, based on its physical limits.

Figure 15:
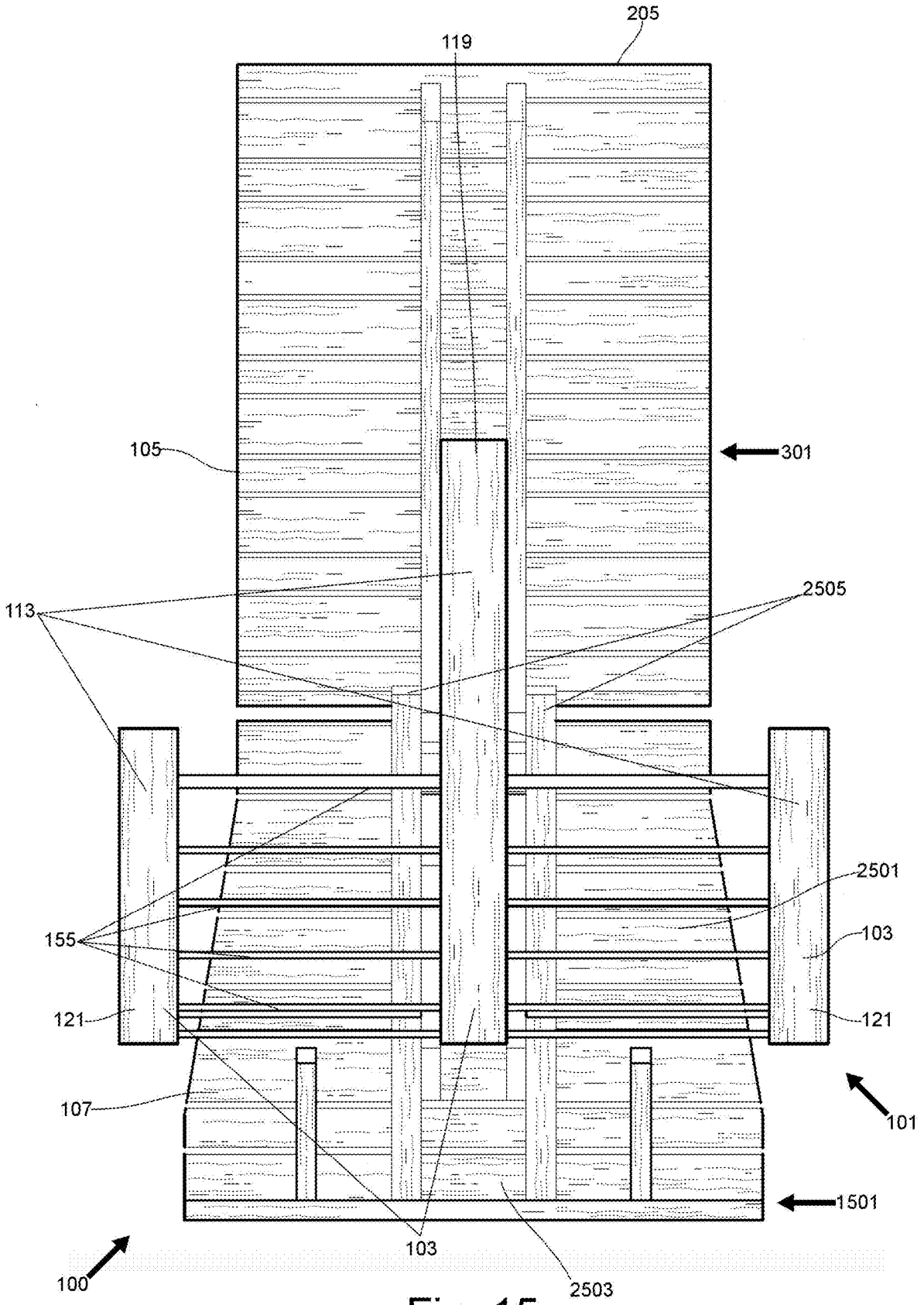
FIG. 15 is a is another bottom view drawing of the same example wide-bodied, slat-constructed chair as shown in FIGS. 1-14, above, in accordance with some additional embodiments of the present application.

FIG. 15 is a is another bottom view drawing of the same example wide-bodied, slat-constructed chair 100, having the same components as shown in FIGS. 1-14, above, in accordance with some additional embodiments of the present application. As shown in the perspective of the drawing, the reclined seatback 105 is in the even more greatly reclined position 301 as pictured for FIG. 3, discussed above. Correspondingly, seat bottom 107 is now shown in an even more forward position 1501 (even farther downward, in the perspective of the figure), corresponding with that even more greatly reclined position 301 of seatback 105. To attain that even more forward position 1501, in some embodiments, single rear leg 119 slid even farther backwards within the seat bottom channel 2503, and against the two seat bottom channel guards 2505, and now appears in an even more rearward position (upward, in the perspective of the figure) relative to the seat bottom 107.

In some embodiments, the even more greatly reclined position 301 is a fully reclined position, meaning that the chair has been reclined to its maximum physical limits.

Figure 16:
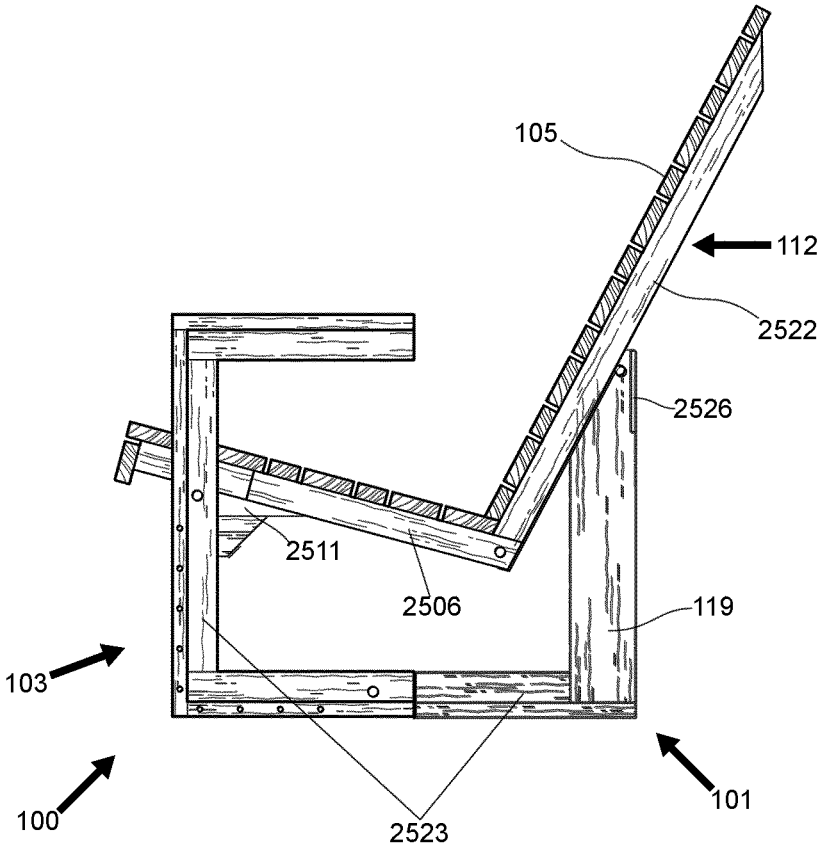
FIG. 16 is a left side view drawing of the same example wide-bodied, slat-constructed chair as shown in FIGS. 1-15, above, in accordance with some additional embodiments of the present application.

FIG. 16 is a left side view drawing of the same example wide-bodied, slat-constructed chair 100, having the same components as shown in FIGS. 1-15, above, in accordance with some additional embodiments of the present application. As shown in the perspective of the drawing, the reclined seatback 105 is in the same position 112 as pictured for FIG. 1, discussed above. From the side view perspective of the figure, the non-quadrilateral base 103, and specialized support structure 101, generally, may be seen, as can one, left-hand side seat bottom channel guard 2506, of the two seat bottom channel guards 2505, discussed above, and a cap piece 2526, covering pivotally-mounted, rotating block 2527 (not visible in the present figure), within the seatback channel formed by seatback channel guards 2521 (of which one, left-hand side seatback channel guard 2522 is visible in the perspective of the figure) as will be discussed further below. A pivoting block 2511, attached to and/or integral with the front portion 145 (not visible in the perspective of the current figure) of the single rear leg 119, is also provided, as will be discussed further below.

Figure 17:
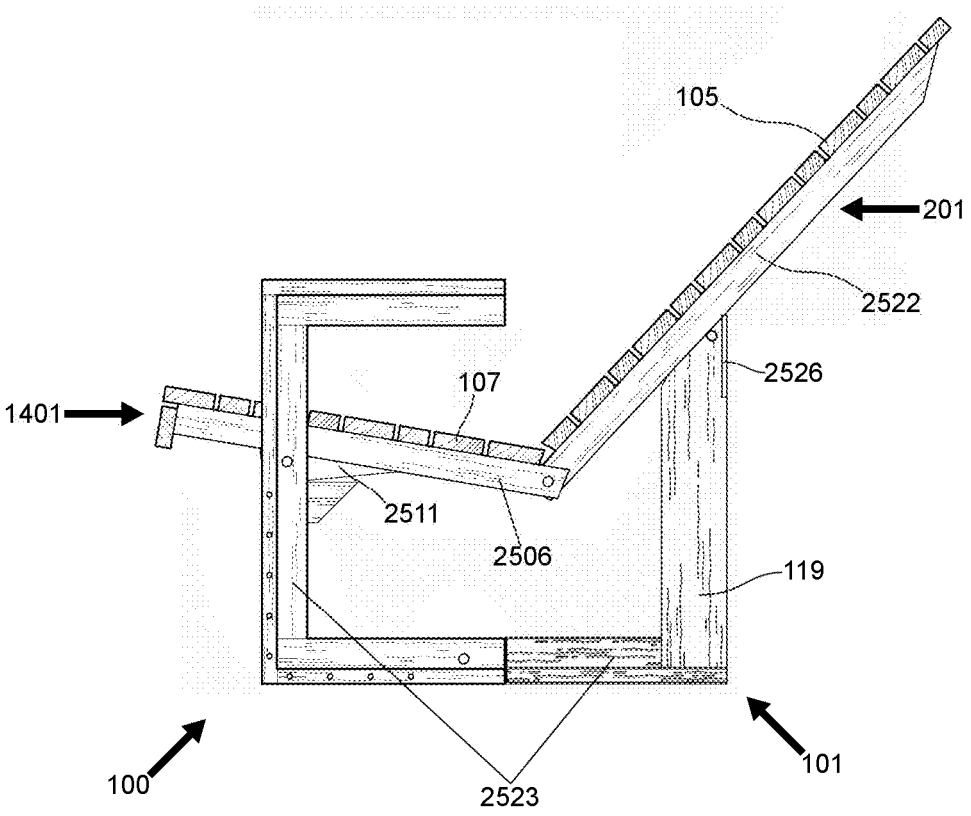
FIG. 17 is another left side view drawing of the same example wide-bodied, slat-constructed chair as shown in FIGS. 1-16, above, in accordance with some additional embodiments of the present application.

FIG. 17 is another left side view drawing of the same example wide-bodied, slat-constructed chair 100, having the same components as shown in FIGS. 1-16, above, in accordance with some additional embodiments of the present application. As shown in the perspective of the drawing, the reclined seatback 105 is in the same more greatly reclined position 201 as pictured for FIG. 2, discussed above. And seat bottom 107 is now shown in the more forward position 1401 (leftward, in the perspective of the figure), corresponding with that more greatly reclined position 201 of seatback 105. To attain that more forward position 1401, in some embodiments, single rear leg 119 slid backwards within the seat bottom channel 2503 (not fully visible in the perspective of the present figure), and against the two seat bottom channel guards 2505 (one such left-hand side seat bottom channel guard 2506 being visible in the present figure), which, in part, form the bottom channel 2503, and, as such, single rear leg 119 now appears in a more rearward position (to the right, in perspective of the figure) relative to the seat bottom 107.

In some embodiments, the more greatly reclined position 201 is a half-reclined position, meaning that the chair has been reclined to an angle about halfway between the minimum and maximum angle, based on its physical limits.

Figure 18:
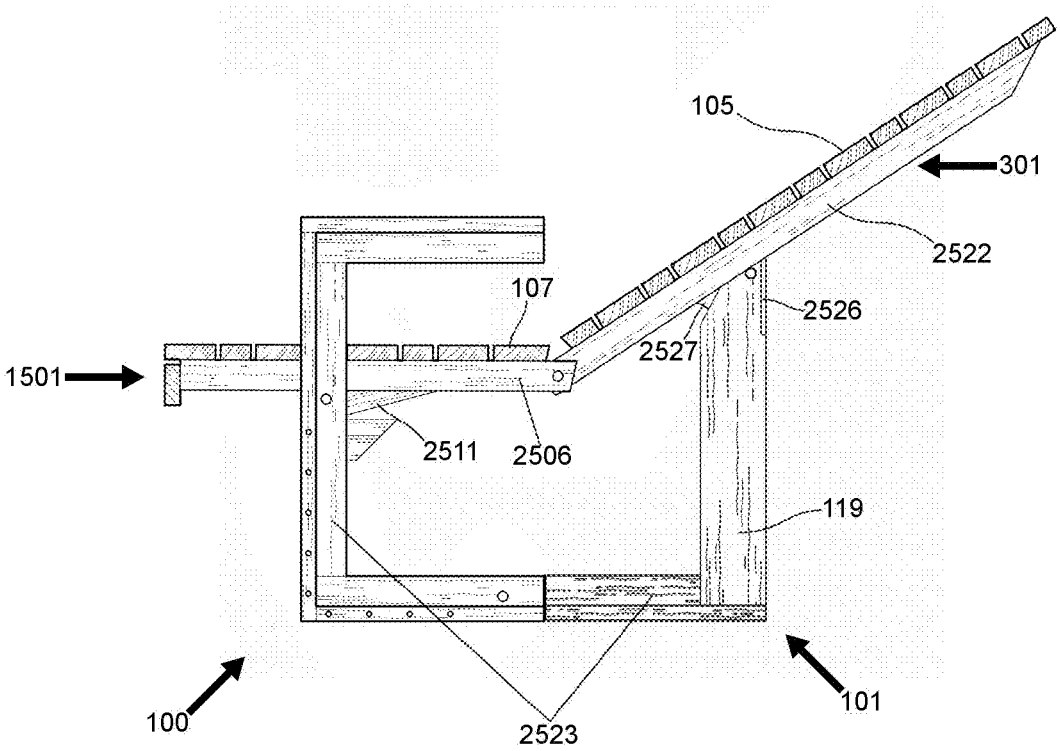
FIG. 18 is another left side view drawing of the same example wide-bodied, slat-constructed chair as shown in FIGS. 1-17, above, in accordance with some additional embodiments of the present application.

FIG. 18 is another left side view drawing of the same example wide-bodied, slat-constructed chair 100, having the same components as shown in FIGS. 1-17, above, in accordance with some additional embodiments of the present application. As shown in the perspective of the drawing, the reclined seatback 105 is in the even more greatly reclined position 301 as pictured for FIG. 3, discussed above. And seat bottom 107 is now shown in the even more forward position 1501 (leftward, in the perspective of the figure), corresponding with that even more greatly reclined position 301 of seatback 105. To attain that even more forward position 1501, in some embodiments, single rear leg 119 slid even further backwards within the seat bottom channel 2503 (not fully visible in the perspective of the present figure), and against the two seat bottom channel guards 2505 (one such left-hand side seat bottom channel guard 2506 being visible in the present figure), which, in part, form the bottom channel 2503, and, as such, single rear leg 119 now appears in a more rearward position (to the right, in perspective of the figure) relative to the seat bottom 107. And, due to a resulting increase in rotation, the pivotally-mounted, rotating block 2527 is now visible in the present figure.

In some embodiments, the even more greatly reclined position 301 is a fully reclined position, meaning that the chair has been reclined to its maximum physical limits.

Figure 19:
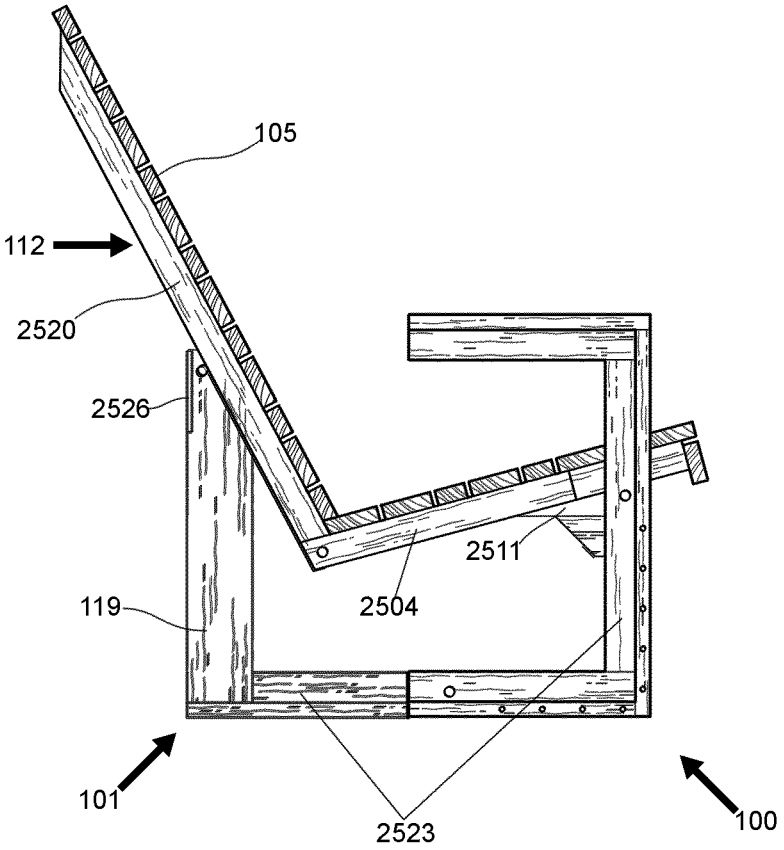
FIG. 19 is a right side view drawing of the same example wide-bodied, slat-constructed chair as shown in FIGS. 1-18, above, in accordance with some additional embodiments of the present application.

FIG. 19 is a right side view drawing of the same example wide-bodied, slat-constructed chair 100, having the same components as shown in FIGS. 1-18, above, in accordance with some additional embodiments of the present application. As shown in the perspective of the drawing, the reclined seatback 105 is in the same position 112 as pictured for FIG. 1, discussed above. From the side view perspective of the figure, the non-quadrilateral base 103, and specialized support structure 101, generally, may be seen, as can one right-hand side seat bottom channel guard 2504, of the two seat bottom channel guards 2505, discussed above, and a cap piece 2526, covering pivotally-mounted, rotating block 2527 (not visible in the present figure), within the seatback channel formed by seatback channel guards 2521 (of which one right-hand side seatback channel guard 2520 is visible in the perspective of the figure) as will be discussed further below. A pivoting block 2511, attached to and/or integral with the front portion 145 (not visible in the perspective of the current figure) of the single rear leg 119, is also provided, as will be discussed further below.

Figure 20:
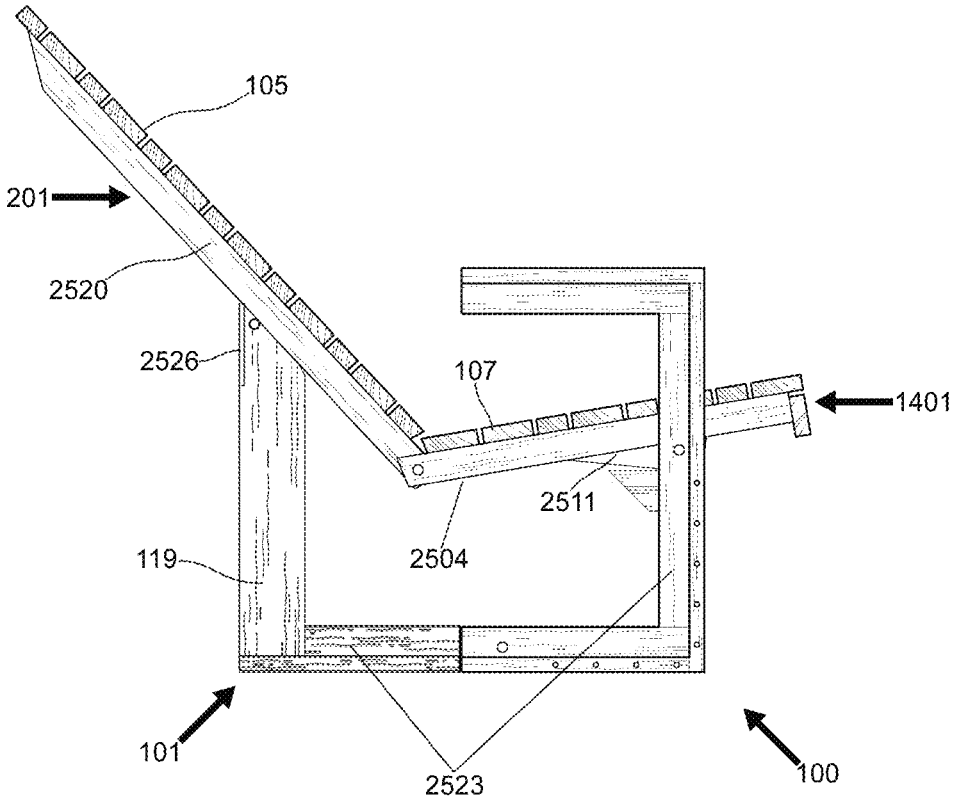
FIG. 20 is another right side view drawing of the same example wide-bodied, slat-constructed chair as shown in FIGS. 1-19, above, in accordance with some additional embodiments of the present application.

FIG. 20 is another right side view drawing of the same example wide-bodied, slat-constructed chair 100, having the same components as shown in FIGS. 1-19, above, in accordance with some additional embodiments of the present application. As shown in the perspective of the drawing, the reclined seatback 105 is in the same more greatly reclined position 201 as pictured for FIG. 2, discussed above. And seat bottom 107 is now shown in the more forward position 1401 (rightward, in the perspective of the figure), corresponding with that more greatly reclined position 201 of seatback 105. To attain that more forward position 1401, in some embodiments, single rear leg 119 slid backwards within the seat bottom channel 2503 (not fully visible in the perspective of the present figure), and against the two seat bottom channel guards 2505 (one such right-hand side seat bottom channel guard 2504 being visible in the present figure), which, in part, form the bottom channel 2503, and, as such, single rear leg 119 now appears in a more rearward position (to the left, in perspective of the figure) relative to the seat bottom 107.

In some embodiments, the more greatly reclined position 201 is a half-reclined position, meaning that the chair has been reclined to an angle about halfway between the minimum and maximum angle, based on its physical limits.

Figure 21:
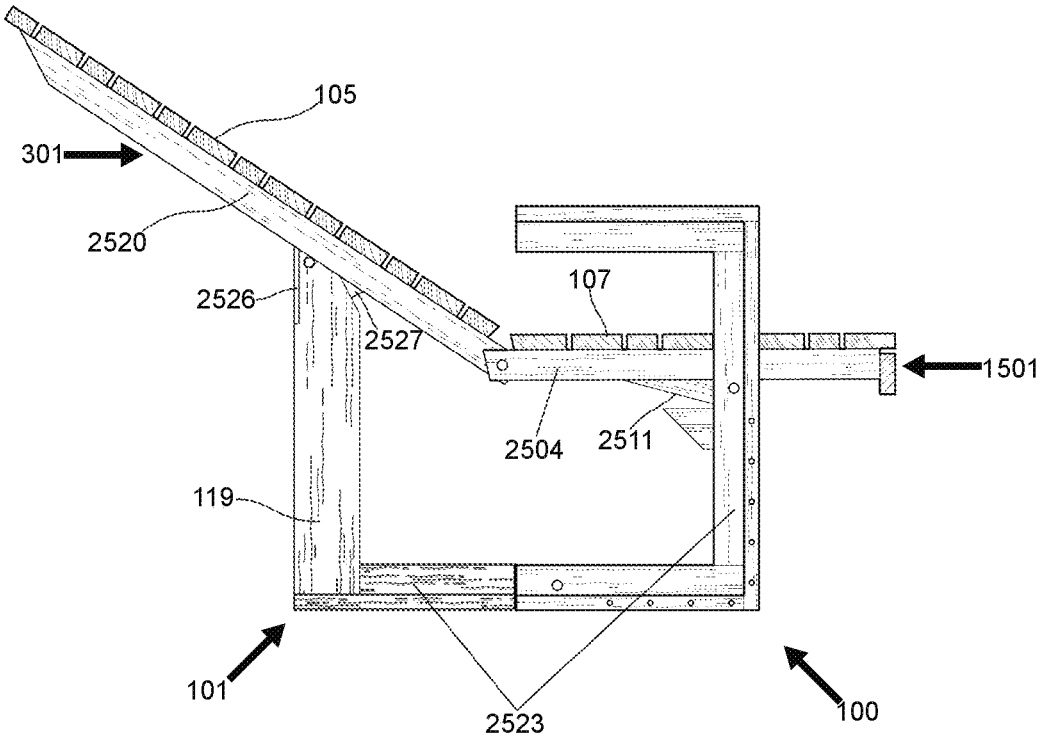
FIG. 21 is another right side view drawing of the same example wide-bodied, slat-constructed chair as shown in FIGS. 1-20, above, in accordance with some additional embodiments of the present application.

FIG. 21 is another right side view drawing of the same example wide-bodied, slat-constructed chair 100, having the same components as shown in FIGS. 1-20, above, in accordance with some additional embodiments of the present application. As shown in the perspective of the drawing, the reclined seatback 105 is in the even more greatly reclined position 301 as pictured for FIG. 3, discussed above. And seat bottom 107 is now shown in the even more forward position 1501 (rightward, in the perspective of the figure), corresponding with that even more greatly reclined position 301 of seatback 105. To attain that even more forward position 1501, in some embodiments, single rear leg 119 slid even further backwards within the seat bottom channel 2503 (not fully visible in the perspective of the present figure), and against the two seat bottom channel guards 2505 (one such right-hand side seat bottom channel guard 2504 being visible in the present figure), which, in part, form the bottom channel 2503, and, as such, single rear leg 119 now appears in a more rearward position (to the left, in perspective of the figure) relative to the seat bottom 107. And, due to a resulting increase in rotation, the pivotally-mounted, rotating block 2527 is now visible in the present figure.

In some embodiments, the even more greatly reclined position 301 is a fully reclined position, meaning that the chair has been reclined to its maximum physical limits.

Figure 22:
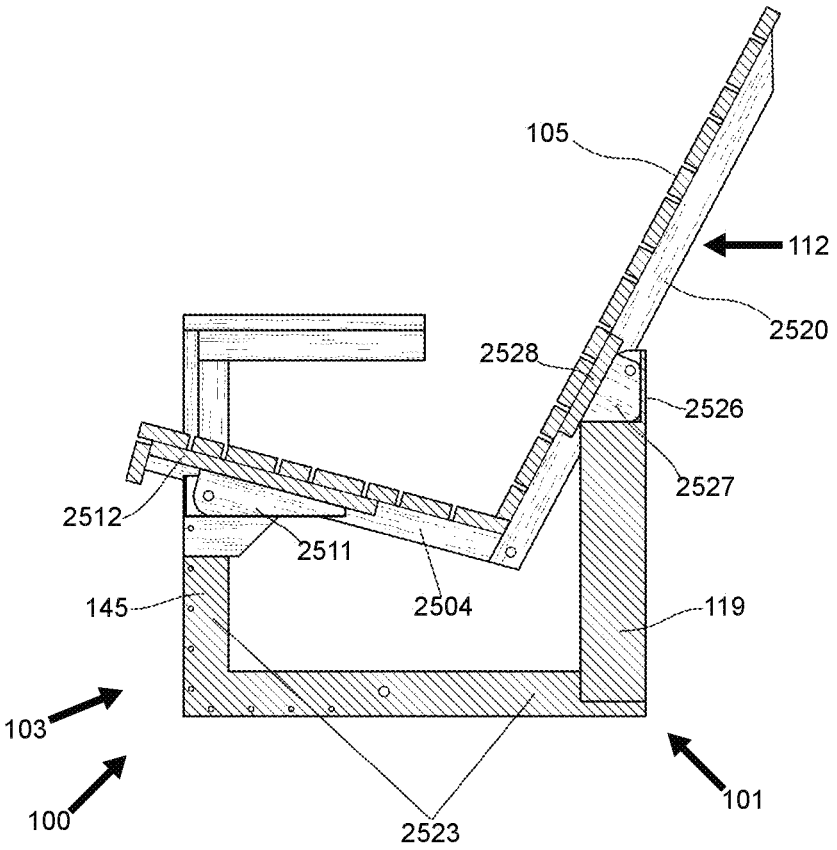
FIG. 22 is a cross-sectional, side view drawing of the same example wide-bodied, slat-constructed chair as shown in FIGS. 1-21, above, in accordance with some additional embodiments of the present application.

FIG. 22 is a cross-sectional, side view drawing of the same example wide-bodied, slat-constructed chair 100, having the same components as shown in FIGS. 1-21, above, in accordance with some additional embodiments of the present application. As shown in the perspective of the drawing, the reclined seatback 105 is in the same position 112 as pictured for FIG. 1, discussed above. From the cross-sectional side view perspective of the figure, the non-quadrilateral base 103, and specialized support structure 101, generally, may be seen, as can one, right-hand side seat bottom channel guard 2504, of the two seat bottom channel guards 2505, discussed above, and a cap piece 2526, covering pivotally-mounted, rotating block 2527 and fixed plate 2528 with which it is integral or attached, within the seatback channel formed by seatback channel guards 2521 (of which one right-hand side seatback channel guard 2520 is visible in the perspective of the figure) as will be discussed further below. A pivoting block 2511, and top plate 2512 thereof, with which it is integral or attached, and also attached to and/or integral with the front portion 145 of the single rear leg 119, is also provided, as will be discussed further below.

Figure 23:
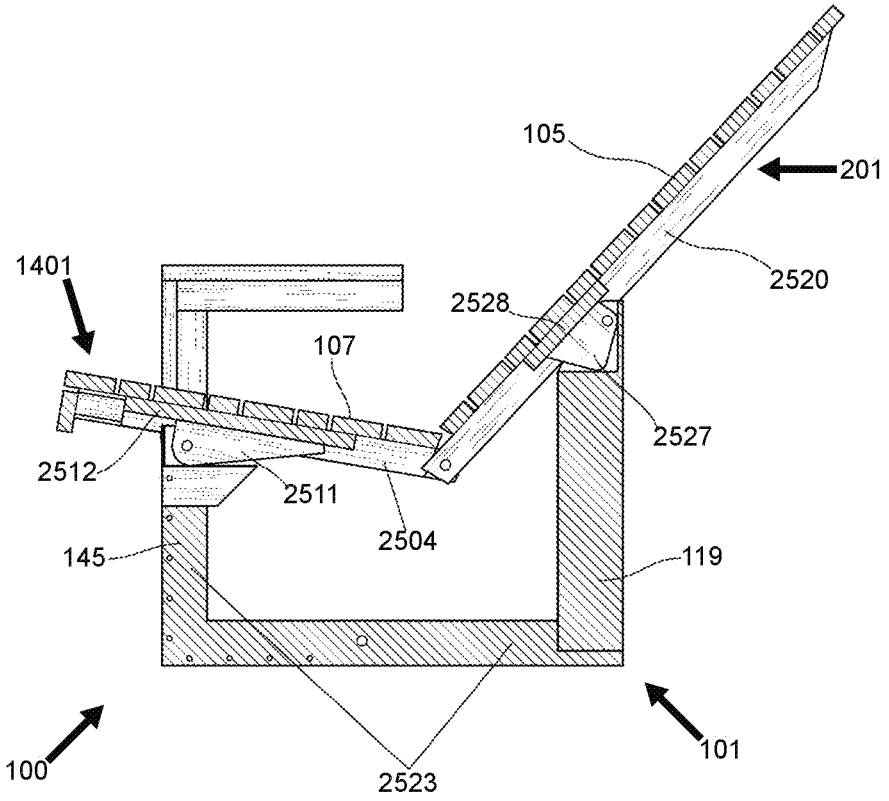
FIG. 23 is another cross-sectional side view drawing of the same example wide-bodied, slat-constructed chair as shown in FIGS. 1-22, above, in accordance with some additional embodiments of the present application.

FIG. 23 is another cross-sectional side view drawing of the same example wide-bodied, slat-constructed chair 100, having the same components as shown in FIGS. 1-22, above, in accordance with some additional embodiments of the present application. As shown in the perspective of the drawing, the reclined seatback 105 is in the same more greatly reclined position 201 as pictured for FIG. 2, discussed above. As shown in the perspective of the drawing, the reclined seatback 105 is in the same more greatly reclined position 201 as pictured for FIG. 2, discussed above. And seat bottom 107 is now shown in the more forward position 1401 (leftward, in the perspective of the figure), corresponding with that more greatly reclined position 201 of seatback 105. To attain that more forward position 1401, in some embodiments, single rear leg 119 slid backwards within the seat bottom channel 2503 (not fully visible in the perspective of the present figure), and against the two seat bottom channel guards 2505 (one such right-hand side seat bottom channel guard 2504 being visible in the present figure), which, in part, form the bottom channel 2503, and, as such, single rear leg 119 now appears in a more rearward position (to the right, in perspective of the figure) relative to the seat bottom 107.

In some embodiments, the more greatly reclined position 201 is a half-reclined position, meaning that the chair has been reclined to an angle about halfway between the minimum and maximum angle, based on its physical limits.

Figure 24:
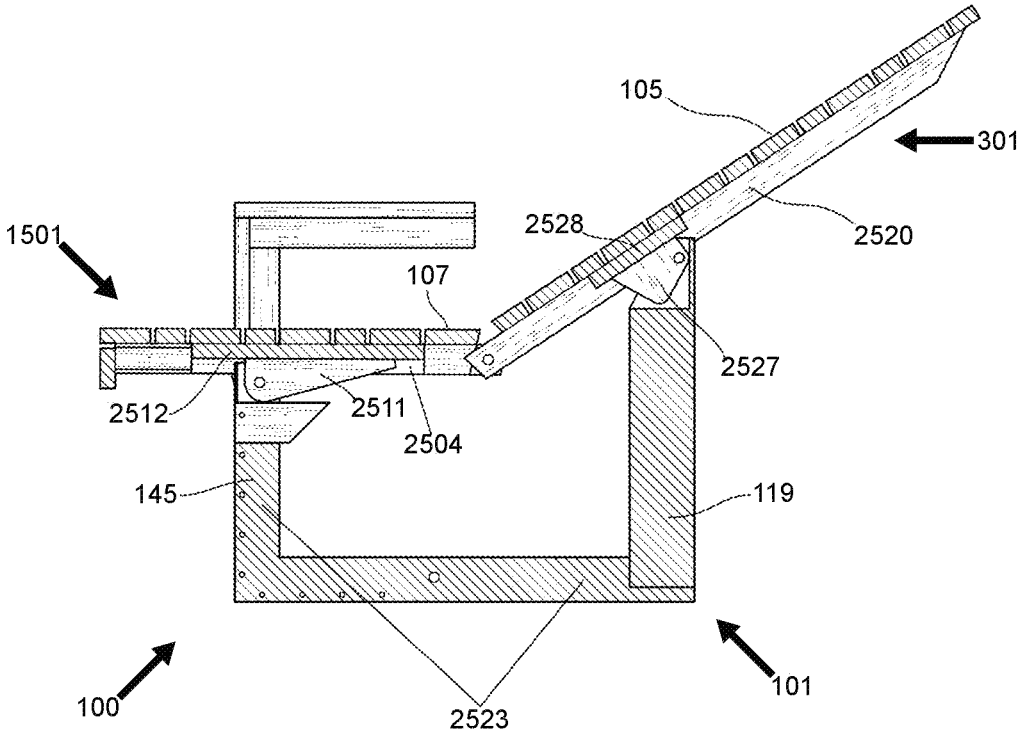
FIG. 24 is another cross-sectional side view drawing of the same example wide-bodied, slat-constructed chair as shown in FIGS. 1-23, above, in accordance with some additional embodiments of the present application.

FIG. 24 is another cross-sectional side view drawing of the same example wide-bodied, slat-constructed chair 100, having the same components as shown in FIGS. 1-23, above, in accordance with some additional embodiments of the present application. As shown in the perspective of the drawing, the reclined seatback 105 is in the even more greatly reclined position 301 as pictured for FIG. 3, discussed above. In some embodiments, the even more greatly reclined position 301 is a fully reclined position, meaning that the chair has been reclined to its maximum physical limits. As shown in the perspective of the drawing, the reclined seatback 105 is in the even more greatly reclined position 301 as pictured for FIG. 3, discussed above. And seat bottom 107 is now shown in the even more forward position 1501 (leftward, in the perspective of the figure), corresponding with that even more greatly reclined position 301 of seatback 105. To attain that even more forward position 1501, in some embodiments, single rear leg 119 slid even further backwards within the seat bottom channel 2503 (not fully visible in the perspective of the present figure), and against the two seat bottom channel guards 2505 (one such right-hand seat bottom channel guard 2504 being visible in the present figure), which, in part, form the bottom channel 2503, and, as such, single rear leg 119 now appears in a more rearward position (to the right, in perspective of the figure) relative to the seat bottom 107. And, due to a resulting increase in rotation, the pivotally-mounted, rotating block 2527 is now more visible in the present figure.

In some embodiments, the even more greatly reclined position 301 is a fully reclined position, meaning that the chair has been reclined to its maximum physical limits.

Figure 25:
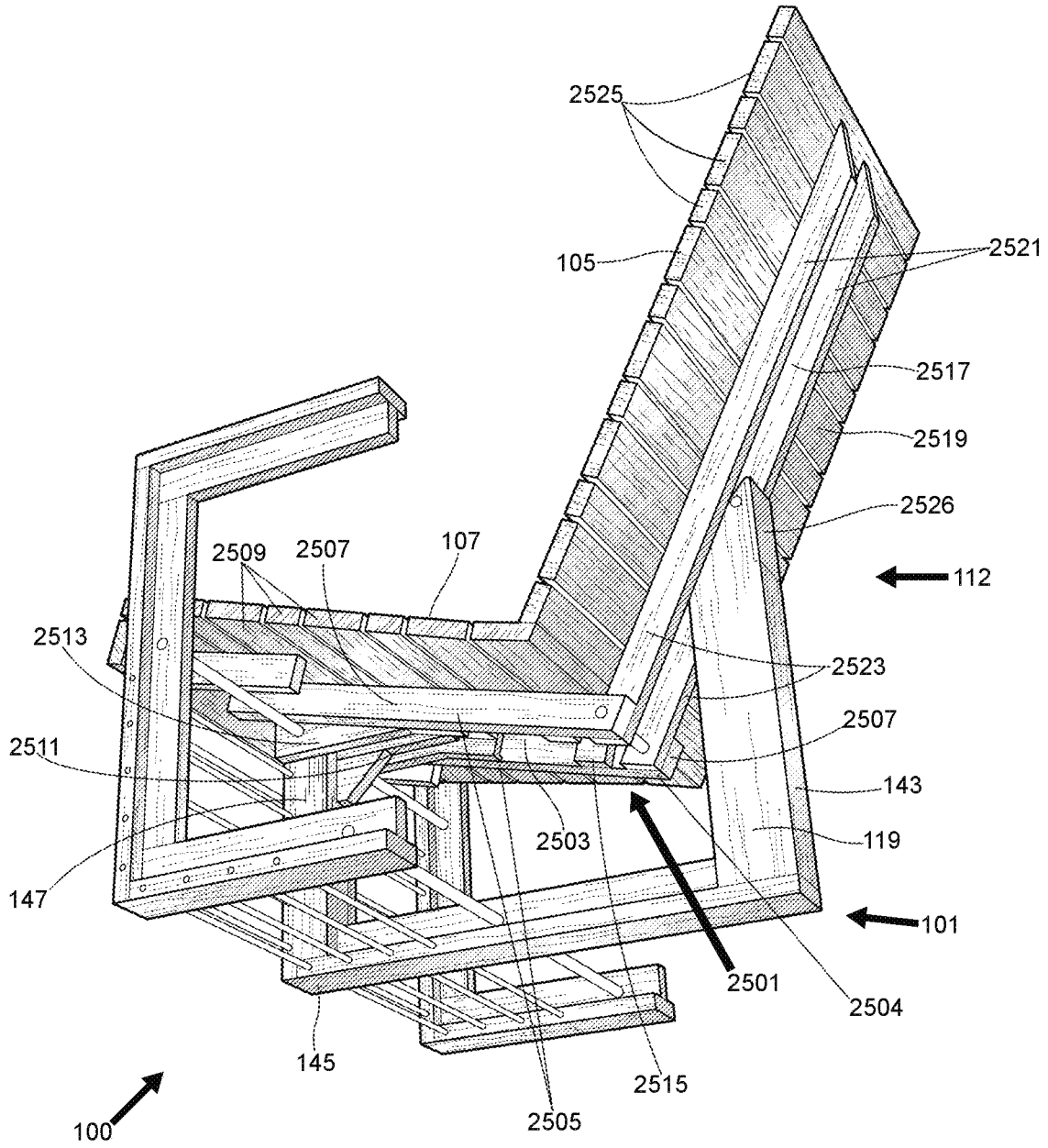
FIG. 25 is another three-quarter perspective drawing of the same example wide-bodied, slat-constructed chair as shown in FIGS. 1-24, above, in accordance with some additional embodiments of the present application.

FIG. 25 is another three-quarter perspective drawing of the same example wide-bodied, slat-constructed chair 100, having the same components as shown in FIGS. 1-24, above, in accordance with some additional embodiments of the present application. However, unlike FIGS. 1-3, which are drawn from an upper three-quarter perspective, the present figure is taken from a lower three-quarter perspective, revealing additional aspects visible from this different perspective. For example, on the now visible underside 2501 of seat bottom 107, a seat bottom channel 2503 is formed from two seat bottom channel guards 2505. In some embodiments, seat bottom channel guards 2505 are formed from long, square undergirding planks 2507 of dimensional lumber, and fastened to the underside 2501 (e.g., via an adhesive or fasteners, such as screw or nails). In some embodiments, seat bottom channel 2503 and seat bottom channel guards 2505 are centered on the underside 2501 of seat bottom 107, on the vertical plane (not pictured) that would bilaterally, symmetrically bisect the chair. In addition to forming a channel, in which other parts may move fore and aft, as will be discussed further below, in some embodiments, seat bottom channel guards 2505 also serve as structural support, holding the many seat bottom slats, such as the examples shown as seat bottom slats 2509, and generally strengthening seat bottom 107.

In some embodiments, a pivoting block 2511, attached to and/or integral with the front portion 145 of the single rear leg 119, is provided, which moves between multiple possible positions within seat bottom channel 2503, and thereby alters the position of seat bottom 107 relative to the non-quadrilateral base 103, and, in turn, the amount that reclined seatback 105 is reclined. More specifically, in some such embodiments, the pivoting block 2511 is attached to and/or integral with, the front vertically-oriented frame component 147 of the front portion 145 of single rear leg 119, via an angled and/or pivotable top portion 2513. In some embodiments, the pivoting block is limited in its fore and aft movement relative to the channel, by channel movement stops, such as the example channel movement stops, such as the example channel movement stop 2515, e.g., in the form of blocks of wood fastened within and at or about the ends of seat bottom channel 2503. In some embodiments, channel movement stops 2515 may include one or more blocks of dimensional lumber, fastened to the interior walls of seat bottom channel 2503.

In some embodiments, a seatback channel 2517 is also formed, on the back side 2519 of reclined seatback 105. For example, in some embodiments, seatback channel 2517 is formed from two seatback channel guards 2521. In some embodiments, seatback channel guards 2521 are formed from long, square undergirding planks 2523 of dimensional lumber, and fastened to the back side 2519 (e.g., via an adhesive or fasteners, such as screw or nails) of reclined seatback 105. In some embodiments, seatback channel 2517 and seatback channel guards 2521 are centered on seatback 105, on the vertical plane (not pictured) that would bilaterally, symmetrically bisect the example wide-bodied, slat-constructed chair 100. In addition to forming a channel, in which other parts may move, as will be discussed further below, in some embodiments, seatback channel guards 2521 also serve as structural support, for example, holding the many seatback slats, such as example seatback slats 2525, and generally strengthening seat back 105.

In some embodiments, a rotating block 2527 is provided (not visible in the present figure), attached to and/or integral with a top portion of the back length 143 of single rear leg 119, and held within seatback channel 2517. In some embodiments, rotating block 2527 is pivotably mounted within seatback channel 2517, such that it remains held within seatback channel 2517 while a user adjusts the amount that reclined seatback 105 is reclined (e.g., between the different positions discussed below).

Figure 26:
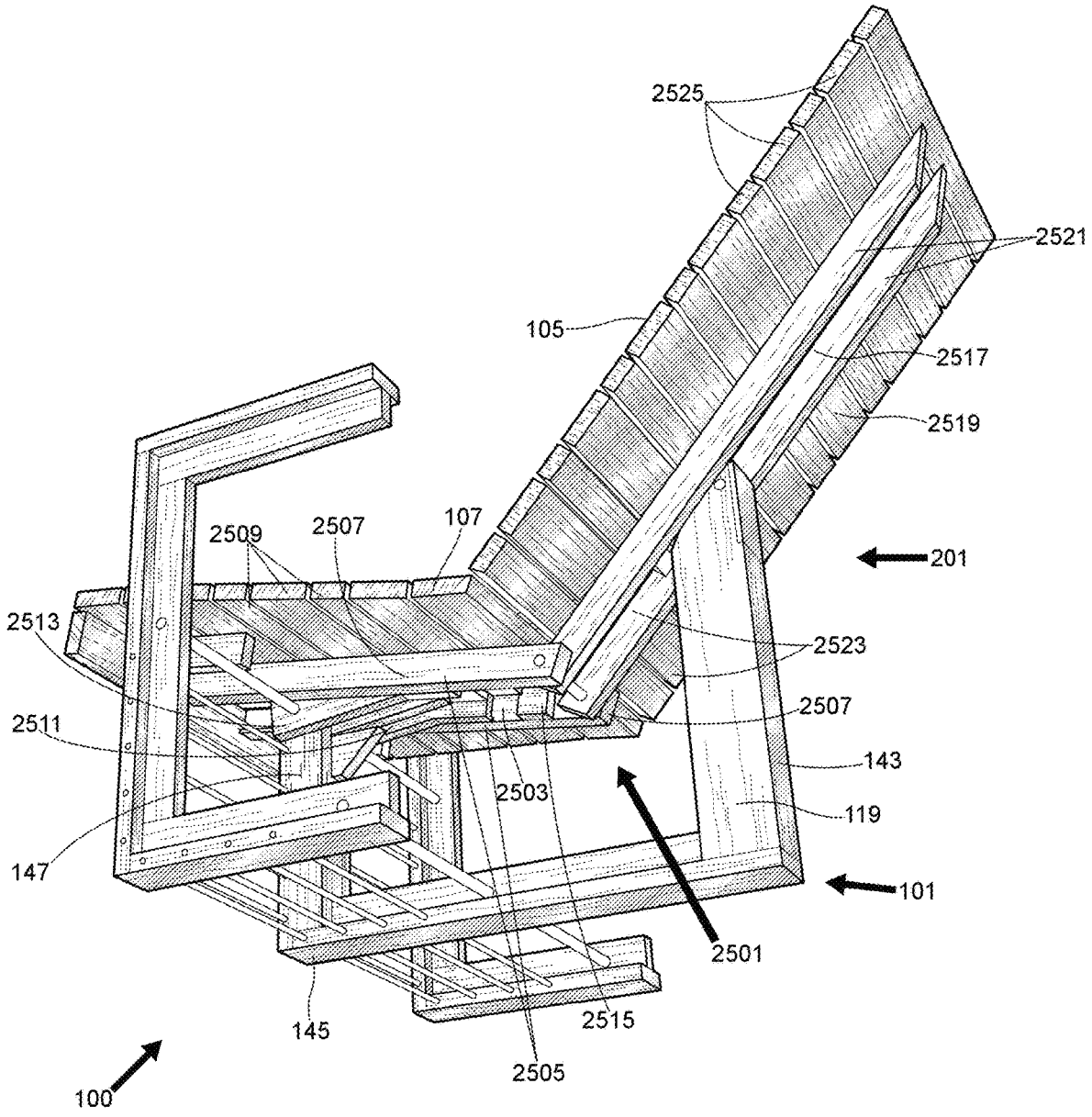
FIG. 26 is another three-quarter perspective drawing of the same example wide-bodied, slat-constructed chair as shown in FIGS. 1-25, above, in accordance with some additional embodiments of the present application.

FIG. 26 is another three-quarter perspective drawing of the same example wide-bodied, slat-constructed chair 100, having the same components as shown in FIGS. 1-25, above, in accordance with some additional embodiments of the present application. As with FIG. 25, discussed above, the present figure is drawn from the same lower three-quarter perspective, revealing additional aspects visible from this different perspective. As shown in the perspective of the drawing, the reclined seatback 105 is in the same more greatly reclined position 201 as pictured for FIG. 2 (and some other figures) discussed above. In some embodiments, the more greatly reclined position 201 is a half-reclined position, meaning that the chair has been reclined to an angle about halfway between the minimum and maximum angle, based on its physical limits. As can be seen, in this half-reclined position, those physical limits (e.g., as enforced by the channel movement stops, such as example channel stop 2515), have not be reached.

Figure 27:
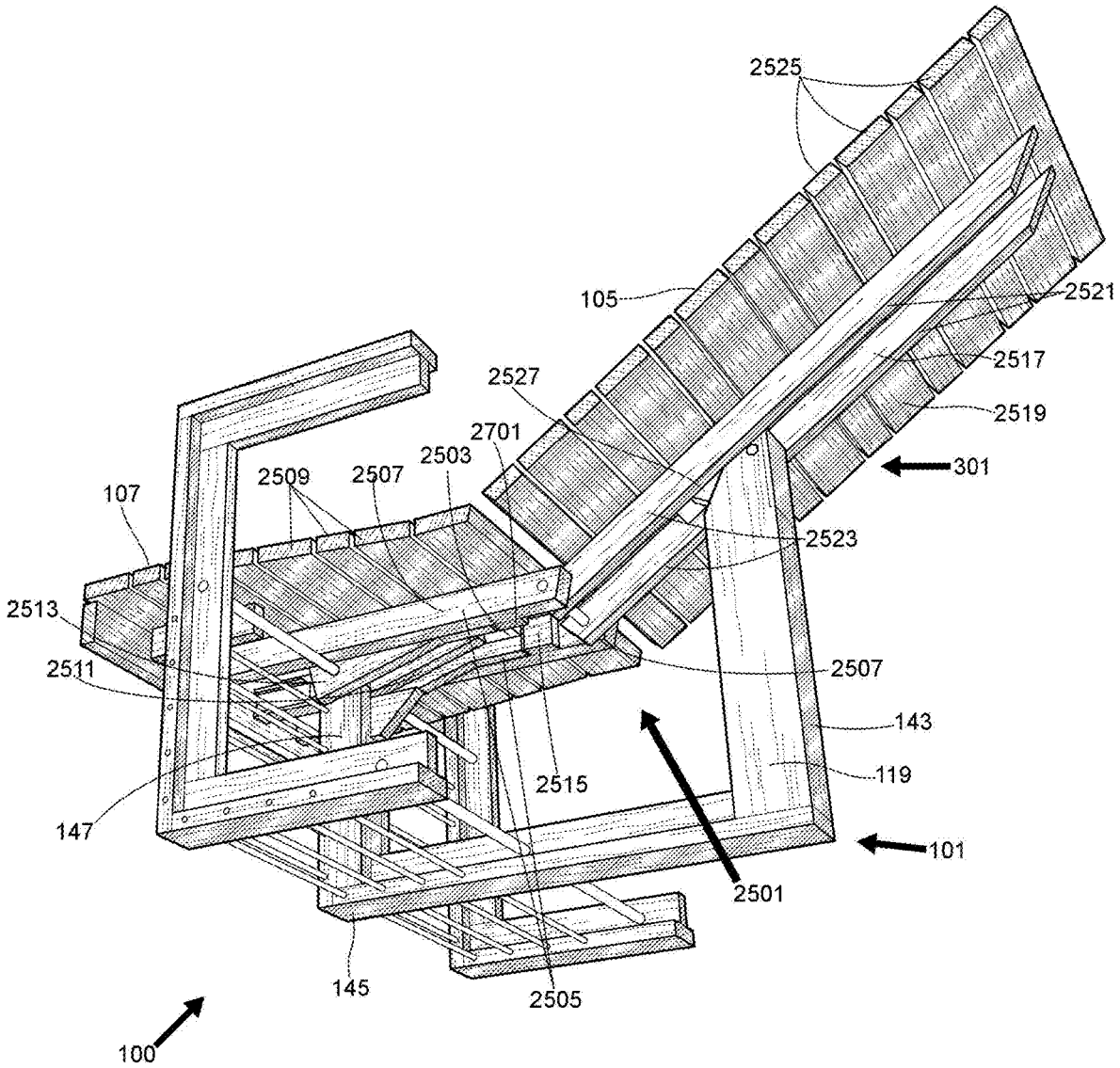
FIG. 27 is another three-quarter perspective drawing of the same example wide-bodied, slat-constructed chair as shown in FIGS. 1-26, above, in accordance with some additional embodiments of the present application.

FIG. 27 is another three-quarter perspective drawing of the same example wide-bodied, slat-constructed chair 100, having the same components as shown in FIGS. 1-26, above, in accordance with some additional embodiments of the present application. As with FIGS. 25 and 26, discussed above, the present figure is drawn from the same lower three-quarter perspective, revealing additional aspects visible from this different perspective. As shown in the perspective of the drawing, the reclined seatback 105 is in the even more greatly reclined position 301 as pictured for FIG. 3, and some other figures, discussed above. In some embodiments, the even more greatly reclined position 301 is a fully reclined position, meaning that the chair has been reclined to its maximum physical limits. For example, in some embodiments, those physical limits are enforced by one or more stops, such as example channel movement stop 2701, against which pivoting block 2511 has now collided, upon reaching the end of the channel seat bottom channel 2503.

Figure 28:
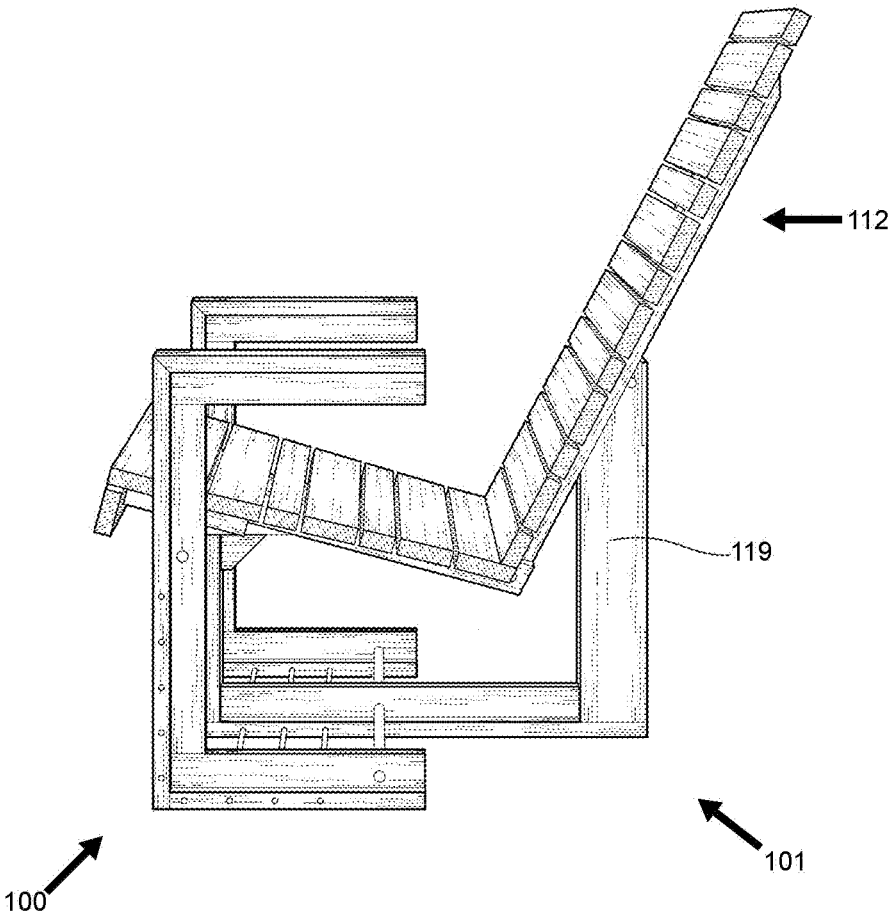
FIG. 28 is a left-top perspective drawing of the same example wide-bodied, slat-constructed chair as shown in FIGS. 1-27, above, in accordance with some additional embodiments of the present application.

FIG. 28 is a left-top perspective drawing of the same example wide-bodied, slat-constructed chair 100, having the same components as shown in FIGS. 1-27, above, in accordance with some additional embodiments of the present application. As shown in the perspective of the drawing, the reclined seatback 105 is in the same position as pictured for FIG. 1, discussed above.

Figure 29:
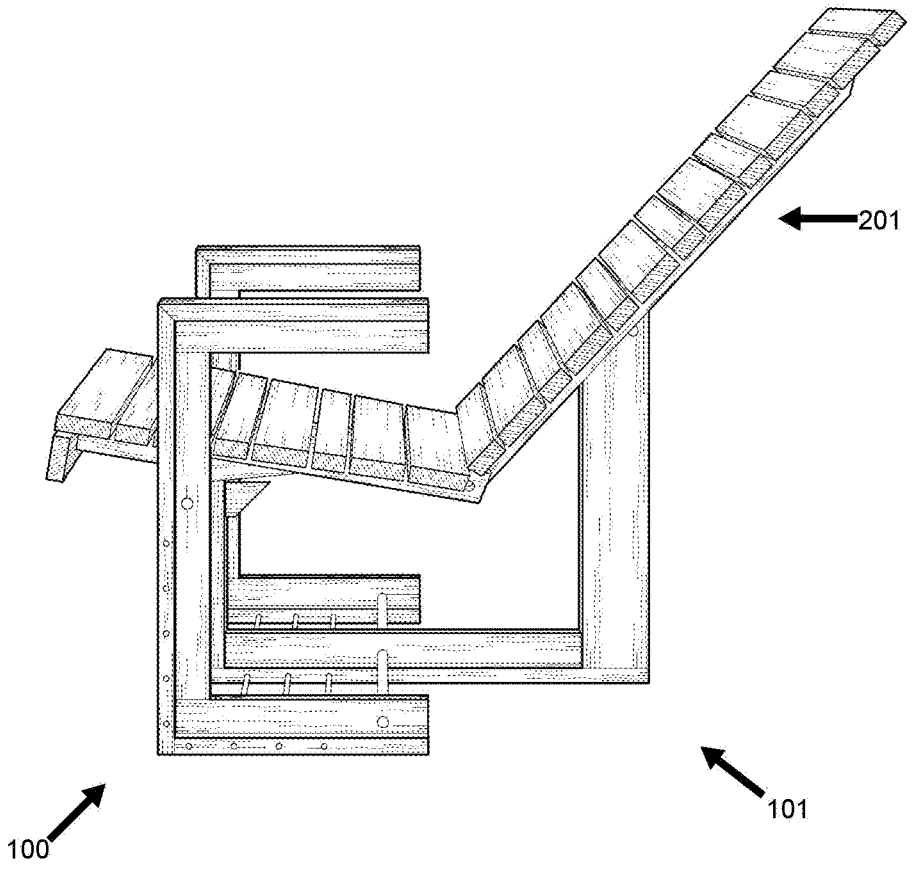
FIG. 29 is a left-top perspective drawing of the same example wide-bodied, slat-constructed chair as shown in FIGS. 1-28, above, in accordance with some additional embodiments of the present application.

FIG. 29 is a left-top perspective drawing of the same example wide-bodied, slat-constructed chair 100, having the same components as shown in FIGS. 1-28, above, in accordance with some additional embodiments of the present application. As shown in the perspective of the drawing, the reclined seatback 105 is in the same more greatly reclined position 201 as pictured for FIG. 2, discussed above. In some embodiments, the more greatly reclined position 201 is a half-reclined position, meaning that the chair has been reclined to an angle about halfway between the minimum and maximum angle, based on its physical limits.

Figure 30:
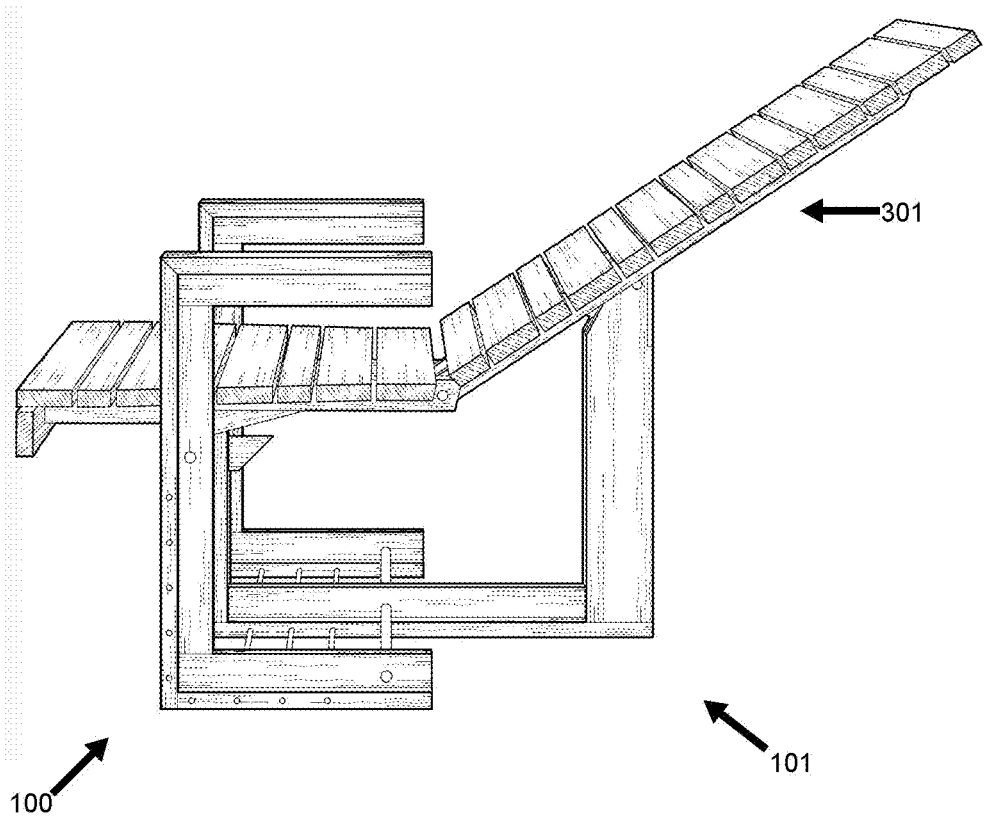
FIG. 30 is a left-top perspective drawing of the same example wide-bodied, slat-constructed chair as shown in FIGS. 1-28, above, in accordance with some additional embodiments of the present application.

FIG. 30 is a left-top perspective drawing of the same example wide-bodied, slat-constructed chair 100, having the same components as shown in FIGS. 1-28, above, in accordance with some additional embodiments of the present application. As shown in the perspective of the drawing, the reclined seatback 105 is in the even more greatly reclined position 301 as pictured for FIG. 3, discussed above. In some embodiments, the even more greatly reclined position 301 is a fully reclined position, meaning that the chair has been reclined to its maximum physical limits.

Figure 31:
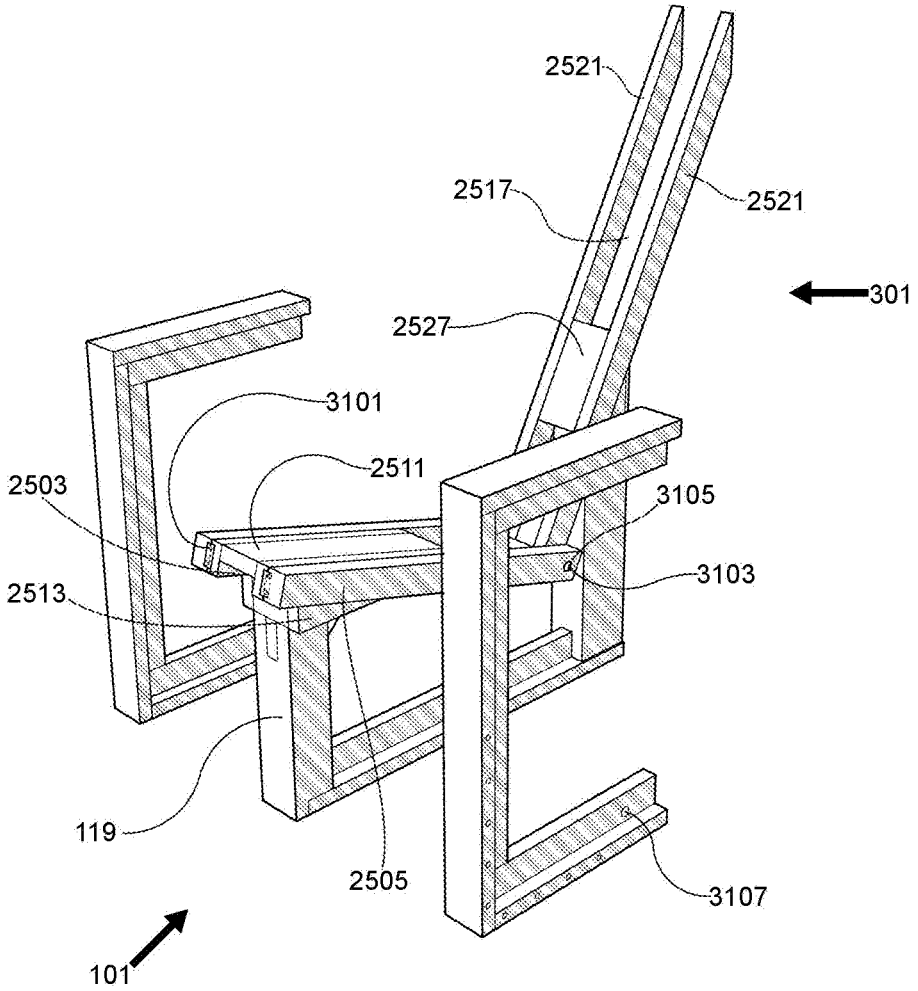
FIG. 31 is a three-quarter perspective drawing of the example specialized support structure of the same example wide-bodied, slat-constructed chair as shown in FIGS. 1-29, above, in accordance with some additional embodiments of the present application.

FIG. 31 is a three-quarter perspective drawing of the example specialized support structure 101 of the same example wide-bodied, slat-constructed chair 100 (not completely pictured in the present figure), having the same components as shown in FIGS. 1-29, above, in accordance with some additional embodiments of the present application. From the isolated perspective view of the figure, certain aspects of some components can be seen more clearly. For example, as with other example embodiments of specialized support structures set forth in the present application, an angled and/or pivotable top portion 2513 of single rear leg 119 can be seen, as well as the pivoting block 2511, which moves within a seat bottom channel 2503, which, in turn, is formed from two seat bottom channel guards 2505, in some embodiments, as discussed above. In some embodiments, such a movement is a linear, sliding movement, and may be facilitated by one or more rails and or bearings, such as the examples shown as rails 3101. In addition, pivotally-mounted, rotating block 2527 can now be seen, within seatback channel 2517, formed by seatback channel guards 2521. In addition, a pivoting hinge 3103 can also be seen, which enables the user to alter the angle between the seatback and seat bottom (neither being pictured in the present figure). In some embodiments, hinge 3103 may include an axel hole 3105. And, in some embodiments, various other components, such as any of the dowels, pins or rods discussed herein, in this application, may also be fastened within other components set forth herein through such holes, such as example dowel, pin or rod fastening hole 3107, which, in some such embodiments, may be threaded and engage with complementary threading on such dowels, pins or rods.

Figure 32:
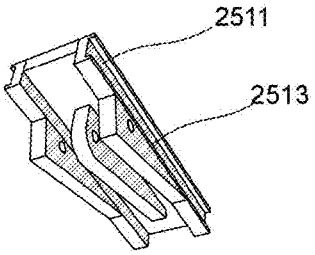
FIGS. 32-35 are perspective drawings of several of the parts of an example specialized support structure, discussed in reference to FIG. 31, above, in accordance with some additional embodiments of the present application.
Figure 33:
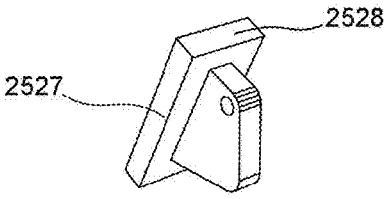
Figure 34:
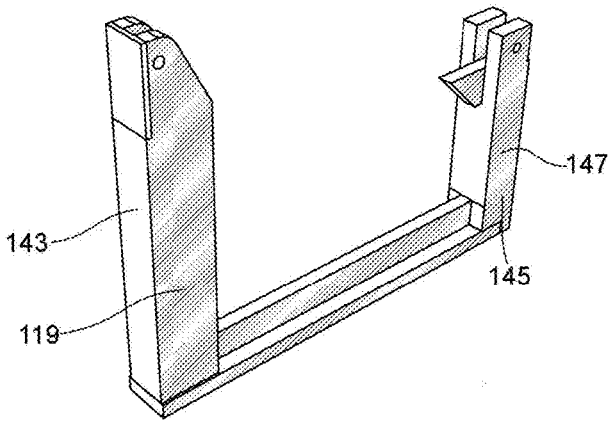
Figure 35:
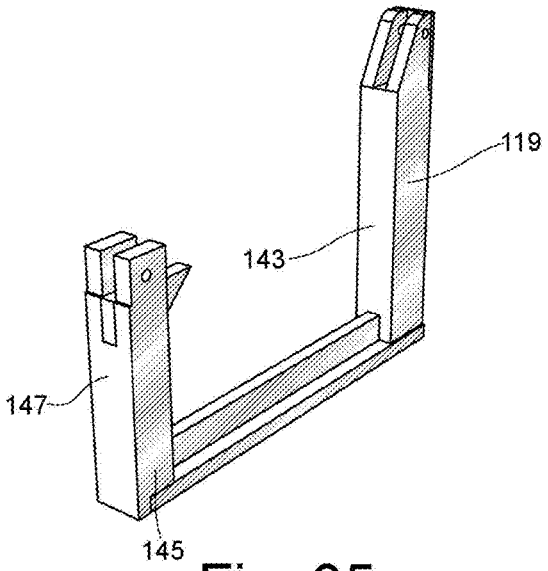

FIGS. 32-35 are drawings of several of the parts of the example specialized support structure 101, discussed immediately above, in accordance with some additional embodiments of the present application. FIG. 32 is an isolated perspective view of an example angled and/or pivotable top portion 2513, which may be attached to and/or integral with the front portion of a central chair back support, and configured for sliding, linear movement within a seat bottom channel, as discussed above. And, in some embodiments, such an angled, pivotable top portion 2513 may include or be connected with a pivoting block 2511, as also discussed above. FIG. 33 is an isolated perspective view of an example pivotally-mounted, rotating block 2527, which includes a fixed plate 2528, as discussed above. FIGS. 34 and 35 are two different isolated perspective views of example single rear leg 119, including its multiple component pieces of rectilinear dimensional wood, as discussed above. As discussed above, in some embodiments, the single rear leg 119 provides adequate support for the reclined seatback 105 (not pictured in the present figures), while increasing the positionability of the chair at an angle along walls and/or within corners. As also discussed above, in some embodiments, rear leg 119 includes a back length 143, and a front portion 145, and a front vertically-oriented frame component 147.

It should be understood that the above components, steps, and number and order of components and steps, is exemplary only of certain embodiments set forth in this application, and are not intended to limit the application in any way. In fact, virtually unlimited alternative orders, numbers, instances of the above steps and components, in addition with countless additional and alternative steps may be performed, within the scope of the present application and inventions herein, as will be readily apparent to those of skill in the art. Although the example of a dimensional lumber (and especially a slat) constructed chair has been provided, it should be understood that any suitable alternative form of wide-bodied chair and components may be used, instead of, or in addition to, such a chair, in various embodiments, while carrying out aspects of the present inventions, as will be readily apparent to those of skill in the art.

What is claimed is:

1. A chair, comprising:

components having a slat construction, including:

a reclinable seatback; and a seat;

a support structure, comprising:

a plurality of C-shaped side frame pieces, comprising abbreviated left- and right-hand side legs; and a center leg, at least partially centered between the left- and right-hand side legs;

wherein the left- and right-hand side legs are connected with the center leg;

wherein the left- and right-hand side legs and the center leg are arranged in a triangular configuration, wherein the center leg extends farther rearward than the left- and right-hand side legs, beyond a back of the seat.

2. The chair of claim 1, comprising:

a plurality of lateral support members, oriented at least generally horizontally, joining the c-shaped side frame pieces with the center leg.

3. The chair of claim 2, wherein the plurality of lateral support members comprise rods or pins.

4. The chair of claim 3, wherein the rods or pins comprise a metal.

5. The chair of claim 1, wherein the support structure comprises wood.

6. The chair of claim 1, wherein the center leg is connected or integral with a center seat supporting block, connected or integral with the seat.

7. The chair of claim 6, wherein the center seat supporting block is connected with the seat at or about a front edge of the seat.

8. The chair of claim 6, wherein the center seat supporting block is connected mid-seat.

9. The chair of claim 1, comprising a reclined seatback.

10. The chair of claim 9, wherein the reclined seatback is user-adjustable.

11. The chair of claim 10, wherein the reclined seatback comprises a seatback channel, formed by seatback channel guards.

12. The chair of claim 11, wherein the reclined seatback comprises a seat bottom channel, formed by seat bottom channel guards.

13. The chair of claim 12, comprising:

a pivoting block, and a front vertically-oriented frame component;

wherein the pivoting block is attached to and/or integral with, the front vertically-oriented frame component and held within the seat bottom channel.

14. The chair of claim 12, comprising stops, limiting the amount that the reclined seatback may be reclined.

15. The chair of claim 1, wherein the seat and reclinable seatback are each at least partially adjustable in position, and the center leg is connected or integral with a central supporting block, abutting and supporting the seat.

16. The chair of claim 15, comprising a user-engageable lock configured to lock the seat and seatback in a plurality of stop positions, and wherein the central supporting block is slidingly engaged with said seat.

* * * * *